US005542769A

United States Patent [19]

Schneider et al.

[11] Patent Number: 5,542,769

[45] Date of Patent: Aug. 6, 1996

[54] PRINTER SUCH AS A PRINTER FOR PRINTING SELF-ADHESIVE LABELS HAVING A RIBBON DRIVE

[75] Inventors: Peter Schneider, Neckargemünd; Dirk Umbach, Hattingen, both of Germany

[73] Assignee: Esselte Meto International GmbH, Heppenheim, Germany

[21] Appl. No.: 311,506

[22] Filed: Sep. 23, 1994

[30] Foreign Application Priority Data

Sep. 24, 1993 [DE] Germany ..... 43 32 562.9

[51] Int. Cl.[6] ..... B41J 33/36

[52] U.S. Cl. ..... 400/225; 400/231

[58] Field of Search ..... 400/223, 225, 400/251, 232, 236

[56] References Cited

U.S. PATENT DOCUMENTS 4,828,408 5/1989 Bekker-Madsen et al. ..... 400/231

FOREIGN PATENT DOCUMENTS 3446010 6/1985 Germany .
3907415 9/1990 Germany .
4108172 9/1992 Germany .
56-62184 5/1981 Japan ..... 400/231
1-72871 3/1989 Japan ..... 400/231
2089734 6/1982 United Kingdom .

OTHER PUBLICATIONS

IBM Technical Disclosure Bulletin, Smart feed feature, Sep. 1990 vol. 32, No. 4.

*Primary Examiner*—John S. Hilten
*Attorney, Agent, or Firm*—Thomas N. Ljungman

[57] ABSTRACT

To conserve relatively expensive printing ribbon, in particular a thermal transfer ribbon, when a portion of the medium which is not to be printed, e.g. the space between two labels, passes through the printing area, after the end of the printing process for a first label or similar item, the thermal transfer ribbon is stopped, and simultaneously the application force of the print head, in particular of the thermal print head, against the counterpressure roller is neutralized, and when the next label or similar item to be printed arrives in the printing area, the pressure on the thermal print head is reactivated, and simultaneously the advance of the thermal transfer ribbon is resumed, whereby the controlled stopping of the thermal transfer ribbon is accomplished by means of a stopping device which stops the first spool from which the ribbon is unwound, and by means of a slip clutch which makes possible the simultaneous stopping of the second spool which winds up the ribbon, in spite of the fact that the drive motor continues to run.

18 Claims, 8 Drawing Sheets

PRINTER SUCH AS A PRINTER FOR PRINTING SELF-ADHESIVE LABELS HAVING A RIBBON DRIVE

BACKGROUND OF THE INVENTION

1. Field of the Invention

The present invention generally relates to a printer with a print head which can be pressed by the force of a spring against a counterpressure roller to print on a material disposed between the counterpressure roller and the print head. Such a print head can also be liftable away from the counterpressure roller. In such a printer, the active strand of a printing ribbon and a medium to be printed preferably run between the print head and the counterpressure roller, and there can preferably be a device to neutralize the application pressure between the print head and the counterpressure roller when the printing ribbon is stationary.

2. Background Information

One such type of printer is disclosed in German Patent No. DE 41 08 172 A1. With such a printer, for example, if labels on a backing medium are to be printed, or if only portions of the medium to be printed are to be printed as labels, there will typically be intermediate areas between two labels, or, in other words, areas which are not printed. To conserve the thermal transfer ink ribbon, therefore, a device is used so that during "economy" operation—during which the medium to be printed is not printed but continues to move past the print head—the thermal print head remains in the printing position and the counterpressure roller is moved into a position away from the print head. The transport of the transfer ribbon is thereby interrupted.

But on such a known printer, it is possible that if there is insufficient distance between the print head and the counterpressure roller, which can occur for a short time, for example, while the counterpressure roller is in motion, the thermal transfer ribbon can be unintentionally advanced if the ribbon comes into contact with the medium being printed, which also continues to advance.

OBJECT OF THE INVENTION

Consequently, the object of the present invention is to improve a printer of the type described above so that the thermal transfer ribbon can be utilized in an optimum fashion.

SUMMARY OF THE INVENTION

The present invention teaches that this object can be achieved by means of a printer control system, by means of which, when the printing ribbon is to remain stationary, a stopping device for the printing ribbon can be moved into an active position.

A typical printer will generally already be equipped with a control system which determines precisely the location in which the medium to be printed is to be printed, and where the spaces are located in the direction of travel. The data necessary for this determination is preferably stored in a computer which can be considered to be a part of the control system. This control system, which can include a computer, can be utilized so that when the "last line" in the direction of travel of the medium to be printed, and of the thermal transfer ribbon has passed through the printing area, the application pressure between the counterpressure roller and the thermal print head can be neutralized. In addition, because, as provided by the present invention, a suitable provision has been made for moving a stopping device for the thermal transfer ribbon into an active position, the thermal transfer ribbon will not be able to continue to move.

Meanwhile, the medium to be printed will still continue to move underneath the now stationary thermal transfer ribbon. With the configuration as provided by the present invention, the print head can be lifted up essentially simultaneously with the stopping of the movement of the thermal transfer ribbon, thus minimizing damage to either the medium or the ribbon. Then, as soon as the position on the printing medium for printing the "first line" arrives in the printing area, the stopping device for the thermal transfer ribbon can be released and the application pressure for the print head can be applied once again to thereby enable printing to be continued. Thus, both the medium being printed and the ribbon once again advance through the printing area, until the next "last line" is reached, whereby the stopping of the ribbon and lifting of the print head can be repeated.

The neutralization of the application pressure can be accomplished, for example, if the thermal print head is moved slightly away from the counterpressure roller, in opposition to the spring force, and therefore with a simultaneous increase of the spring force. In this case, wherein the ribbon movement is also stopped, even a fraction of a millimeter can typically be sufficient movement for the print head. On the other hand, of course, the counterpressure roller can be moved away from the thermal print head until the spring is essentially completely relaxed, and thereby no longer applies pressure onto the counterpressure roller. But for this purpose, as a rule, a greater range of travel is typically required, for which reason preference is given to the first variant mentioned above.

In such a printing system, the printing ribbon can preferably be unwound from a first spool, can be guided through the printing area, and can then be wound up on a second spool. By means of the stopping device in accordance with the present invention, the thermal transfer ribbon can be directly or indirectly stopped at a position provided for that purpose. For example, one such position that such a stoppage could be performed could preferably be at a position above the unwinding spool.

In one preferred embodiment of the invention, a slip clutch is interposed between the drive mechanism for the printing ribbon and a spool driven by the drive mechanism for taking up the printing ribbon. As a result of the stopping of the thermal transfer ribbon, the driven side of the slip clutch, i.e. the second spool, for example, can no longer turn, as the ribbon would be unable to be pulled. On account of the interposed slip clutch, however, the drive motor can continue to run, essentially without any damage to the drive mechanism itself or to the thermal transfer ribbon. When the thermal transfer ribbon is released by the stopping device, the forward transport of the ribbon can then continue by means of the clutch, which no longer slips, and by means of the drive motor. The present invention teaches that if necessary, the control system of the printer can also actuate a drive mechanism which lifts the counterpressure roller away from the thermal print head, or which lifts the thermal print head away from the counterpressure roller.

In one refinement of the present invention, the thermal transfer ribbon can be indirectly stopped by stopping the first spool, in which case the stopping device interacts with the first spool. But that does not mean that the stopping device necessarily has to act directly on the first spool. Quite the contrary, all that would typically be necessary is for the stopping device to act on an element which is non-rotationally connected to the first spool.

In this regard, and as claimed by an additional configuration of the present invention, the first spool can be non-rotationally connected to an externally-toothed wheel. This externally toothed wheel can be configured to interact with a locking tooth which can be engaged with and disengaged from the toothed wheel by means of the control system. The locking tooth can preferably be engaged in any space between two adjacent teeth, and can thereby stop the rotation of this externally-toothed wheel. Thus, the non-rotationally connected first spool would also stop moving. The ribbon would then essentially no longer be able to be unwound from this first spool, and consequently would essentially no longer be wound up on the second spool.

In accordance with the present invention, a tooth which is pointed has been found to be a less appropriate tooth shape, while rectangular or sawtooth shapes have been found to be more appropriate. If the tooth cannot immediately enter into a space between two teeth, essentially the latest that the tooth will enter into such a space is when, viewed in the direction of rotation, the locking tooth is inserted into the next tooth space. Of course, there should be suitable provisions to enable the tooth to securely execute the engagement, or locking motion. The same is essentially true for the disengagement, or unlocking motion.

An additional variant of the invention is characterized by the fact that the locking tooth can preferably be located on a pivoting arm which can be retained in an inactive position by means of a controllable locking element. The locking element can preferably be moved by means of the printer control system into an inactive position so that the pivoting arm can execute the pivoting motion necessary for the locking. This can be done, for example, by means of some auxiliary force, e.g. a biasing, or spring force, or by means of gravity, in which case it is assumed that the pivoting arm would be in a raised pivot position when the locking tooth is disengaged, and can be free to fall into engagement with the teeth when released.

In a particularly preferred embodiment of the present invention, the locking element can preferably be moved from its engaged position into a disengaged position and vice-versa by means of a controllable drive mechanism. At the appropriate time, the control mechanism of the printer can actuate the controllable drive mechanism for the locking element, whereupon the locking element can be moved from its active position into its inactive position or vice versa. When the thermal transfer ribbon is once again to be unwound so that it is available for printing, the controllable drive mechanism can preferably move the locking element back into its inactive position.

The locking element can very advantageously be located on a lever which can be mounted so that it can pivot. The lever can preferably be adjusted by means of a cam drive mechanism which forms the controllable drive mechanism. If the cam is rotated, the rotation can cause a pivoting of a lever connected thereto, and this pivoting movement can be used for the pivoting movement of the pivoting arm with the locking tooth into the engaged position and into the disengaged position.

In one refinement of the present invention, a pin could be eccentrically attached to a drivable rotational element, and this pin could be engaged in a slot which is located on the pivoting lever, at some distance from the axis of rotation of the pivoting lever. This pin-slot connection, can make it possible to convert a rotational movement into a back-and-forth pivoting movement. For this purpose, the rotational element can preferably execute a rotation of only approximately 180 degrees to move the locking device from its active position into its inactive position or vice-versa. The slot is thereby oriented at right angles to the direction of excursion of the lever.

An additional preferred embodiment of the present invention provides the use of an angular lever as the pivoting lever. Such an angular lever results in numerous advantages, the foremost of which provides for a compact construction.

But, an additional advantage can be provided by the actuation of the stopping device. When the angled lever is oriented with one leg vertically, with the pivoting arm located thereabove, the pivoting arm which has or supports the locking tooth can be brought into the locking position either by means of a spring or in another manner, or by means of gravity when the toothed wheel is located therebelow. A simple raising and lowering of the vertical arm of the angled lever can thereby allow the locking tooth to engage, and be disengaged from the toothed wheel. In essence, it has been found that the use of gravity alone has advantages, primarily with regard to being able to essentially provide the smoothest possible location of the next space between teeth.

In addition, in another particularly appropriate variant of the present invention, the other leg of the angled lever can preferably extend into the vicinity of the print head. As such, the print head can be moved essentially simultaneously with the pivoting arm. Accordingly, an adjustment drive mechanism for the thermal print head, i.e. a drive mechanism by means of which the thermal print head can be raised from the counterpressure roller when the thermal transfer ribbon is stationary, can also be used to stop or start the thermal transfer ribbon. From this point of view, therefore, the result in accordance with the present invention provides a compact and therefore economical configuration of this portion of the printer. An additional advantage is that the number of parts involved is small, which is advantageous in terms of reduced susceptibility to malfunctions.

In summary, one aspect of the invention resides broadly in a printer for printing labels on a label material by transferring a printing substance from a printing ribbon to the label material, the printer comprising: apparatus for storing label material to be printed upon; apparatus for storing printing ribbon, the printing ribbon comprising a printing substance thereon; print apparatus for printing on the label material, the print apparatus comprising at least one printing element, and the at least one printing element comprising apparatus for transferring the printing substance from the printing ribbon to the label material; apparatus for feeding printing ribbon and label material to an area adjacent the at least one printing element; apparatus for actuating the at least one printing element to transfer printing substance from the printing ribbon to the label material to print on the label material adjacent the at least one printing element; the apparatus for feeding comprising apparatus for conjunctively feeding printing ribbon and label material through the area adjacent the at least one printing element during at least first periods of operation of the printer; and apparatus for inhibiting transport of the printing ribbon by the apparatus for conjunctively feeding during transport of the label material by the apparatus for conjunctively feeding during at least second periods of operation of the printer.

Another aspect of the invention resides broadly in a printer for transferring a printing substance from a printing ribbon to a material, the printer comprising: apparatus for storing the material to be printed upon; apparatus for storing printing ribbon, the printing ribbon comprising a printing substance thereon; print apparatus for printing on the material, the print apparatus comprising at least one printing element, and the at least one printing element comprising apparatus for transferring the printing substance from the printing ribbon to the material; apparatus for feeding printing ribbon and material to an area adjacent the at least one printing element; apparatus for moving the at least one printing element into and out of engagement with the printing ribbon and material, the apparatus for moving being configured for moving the at least one printing element into engagement during at least first periods of operation of the printer and for moving the at least one printing element out of engagement during at least second periods of operation of the printer; apparatus for actuating the at least one printing element to transfer printing substance from the printing ribbon to the material to print on the material adjacent the at least one printing element; the apparatus for feeding comprising apparatus for conjunctively feeding printing ribbon and material through the area adjacent the at least one printing element during at least the first periods of operation of the printer; and apparatus for inhibiting transport of the printing ribbon by the apparatus for conjunctively feeding during transport of the material by the apparatus for conjunctively feeding during at least the second periods of operation of the printer.

BRIEF DESCRIPTION OF THE DRAWINGS

Additional configurations, advantages, characterizing features and details of the present invention, as well as the corresponding operation of the present invention, are provided herebelow in the following description of the preferred embodiments, with reference to the accompanying drawings, in which.

BRIEF DESCRIPTION OF THE PREFERRED EMBODIMENTS

Figure 1:
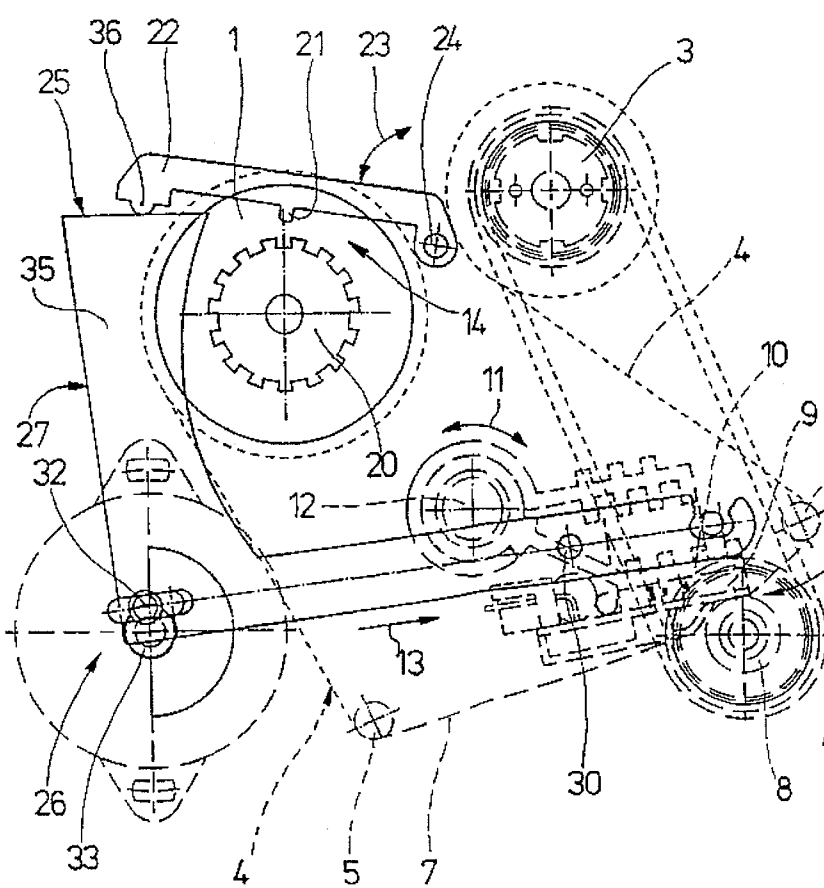
FIG. 1 is a side view of a portion of a thermal transfer printer in the vicinity of the thermal print head and the ribbon drive mechanism in the operating position.

As shown in FIG. 1, a printer for printing labels can generally have a printing area 2. One such type of printer can include a thermal transfer printer, further detailed herebelow with reference to FIG. 3. In a printer, or thermal transfer printer, an ink ribbon, or thermal transfer ribbon 4 can be unwound from a first spool 1, can be guided through the printing area 2, and can then be wound up on a second spool 3, which could alternately be termed a "take-up spool". The two spools 1 and 3, are preferably located in an ink ribbon cassette, discussed in more detail herebelow with reference to FIGS. 4–16. In addition to the spools 1 and 3, guide rollers 5 and 6 can also preferably be a part of the ink ribbon cassette.

A portion of the thermal transfer ribbon 4 which extends between the guide rollers 5 and 6 can essentially be termed an active strand 7 of the ribbon 4. In the depicted embodiment, this active strand 7 is preferably guided by means of a counterpressure roller 8 on the printer. Between the thermal transfer ribbon 4 and the counterpressure roller 8, a medium to be printed can preferably be guided. Such a printing medium, which is depicted in more detail in FIGS. 3 and 4, can, for example, include a backing strip which carries labels to be printed. During printing, a thermal print head 9 would typically be disposed in contact with the moving, working strand 7 of the thermal transfer ribbon 4 and, with the interposition of the above-mentioned medium to be printed, presses the thermal transfer ribbon 4 and printing medium firmly against the counterpressure roller 8.

Figure 2:
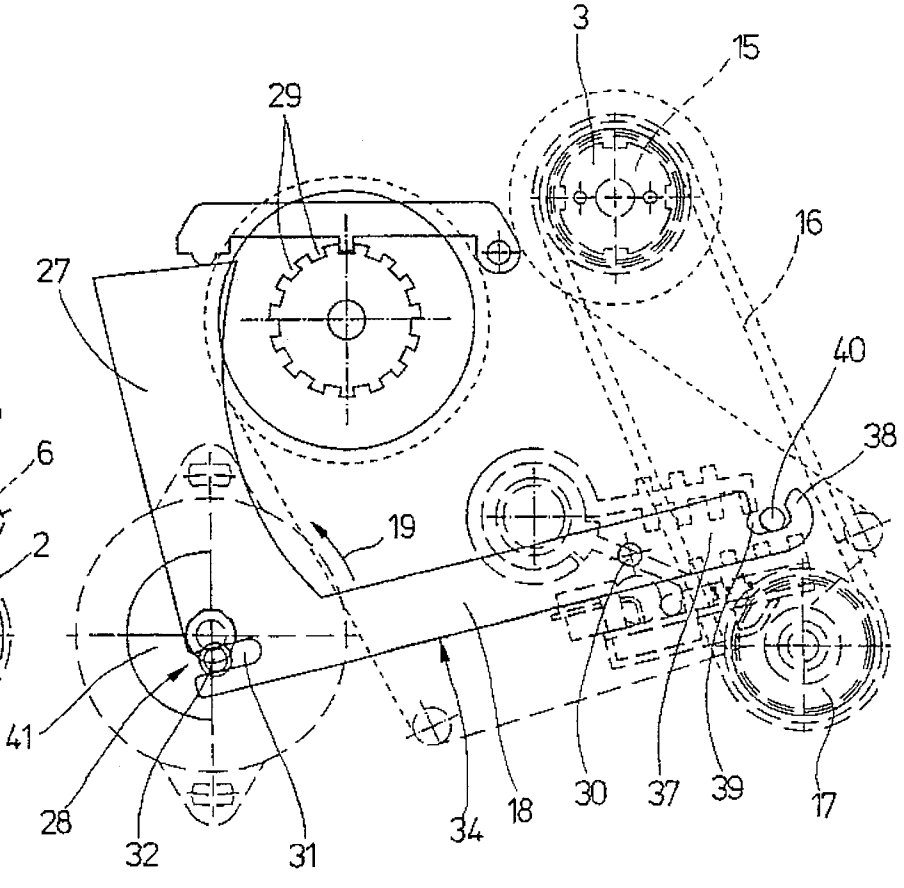
FIG. 2 is a comparable representation showing a released thermal transfer ribbon.
Figure 2A:
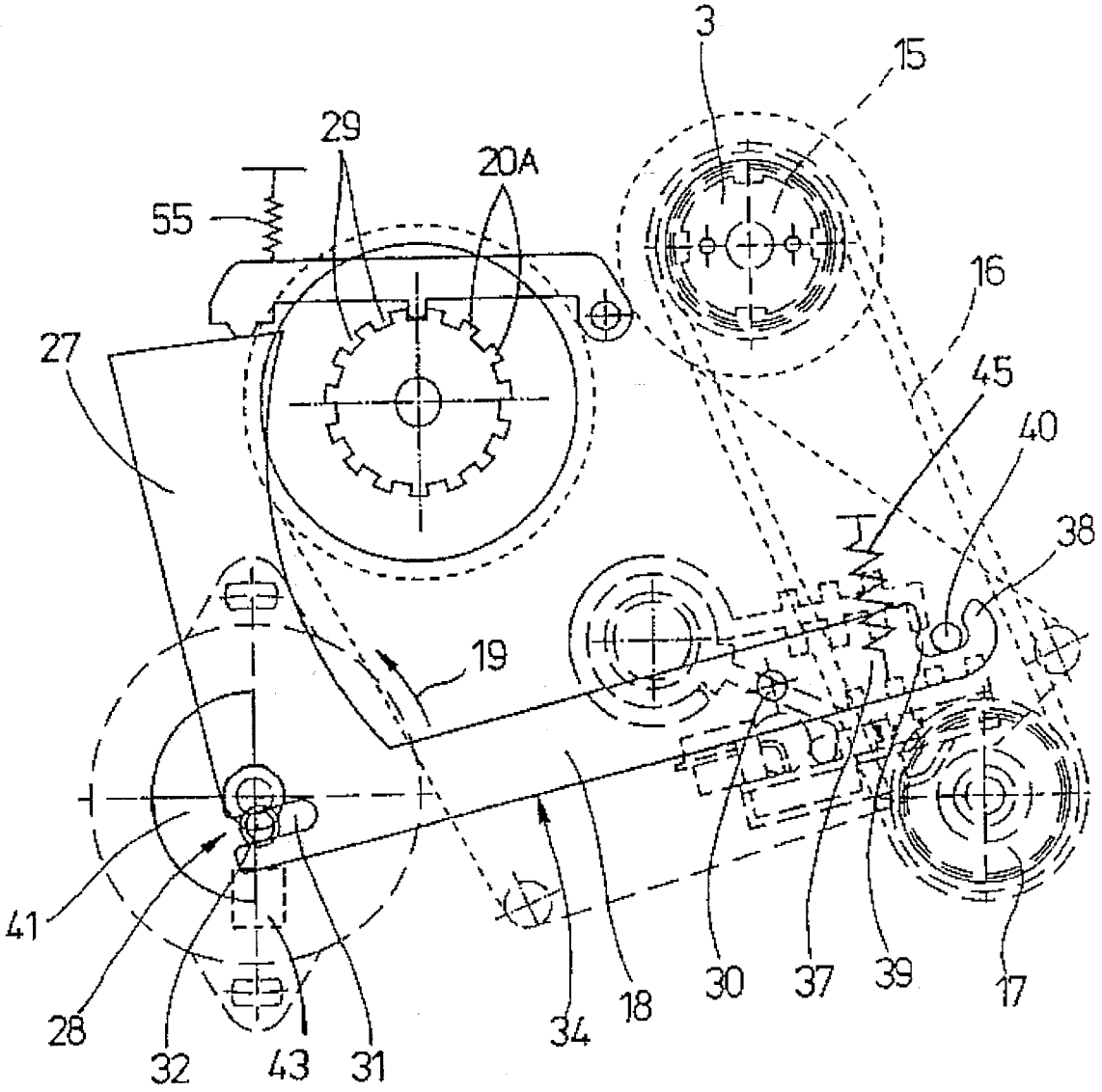
FIG. 2A shows a more detailed representation of the printer as depicted in FIG. 2.

The application force for pressing the thermal transfer ribbon 4 and printing medium firmly against the counterpressure roller 8 can be applied by a biasing device, such as, for example, a coil compression spring 45, which is shown in FIG. 2*a*. This coil compression spring 45 preferably pushes on a pivoting arm 10. The pivoting arm 101 supports the thermal print head 9. The above-mentioned arm 10, which is pushed down by the coil compression spring 45, can pivot around the axis 12 in the direction indicated by the double arrow 11.

Figure 3:
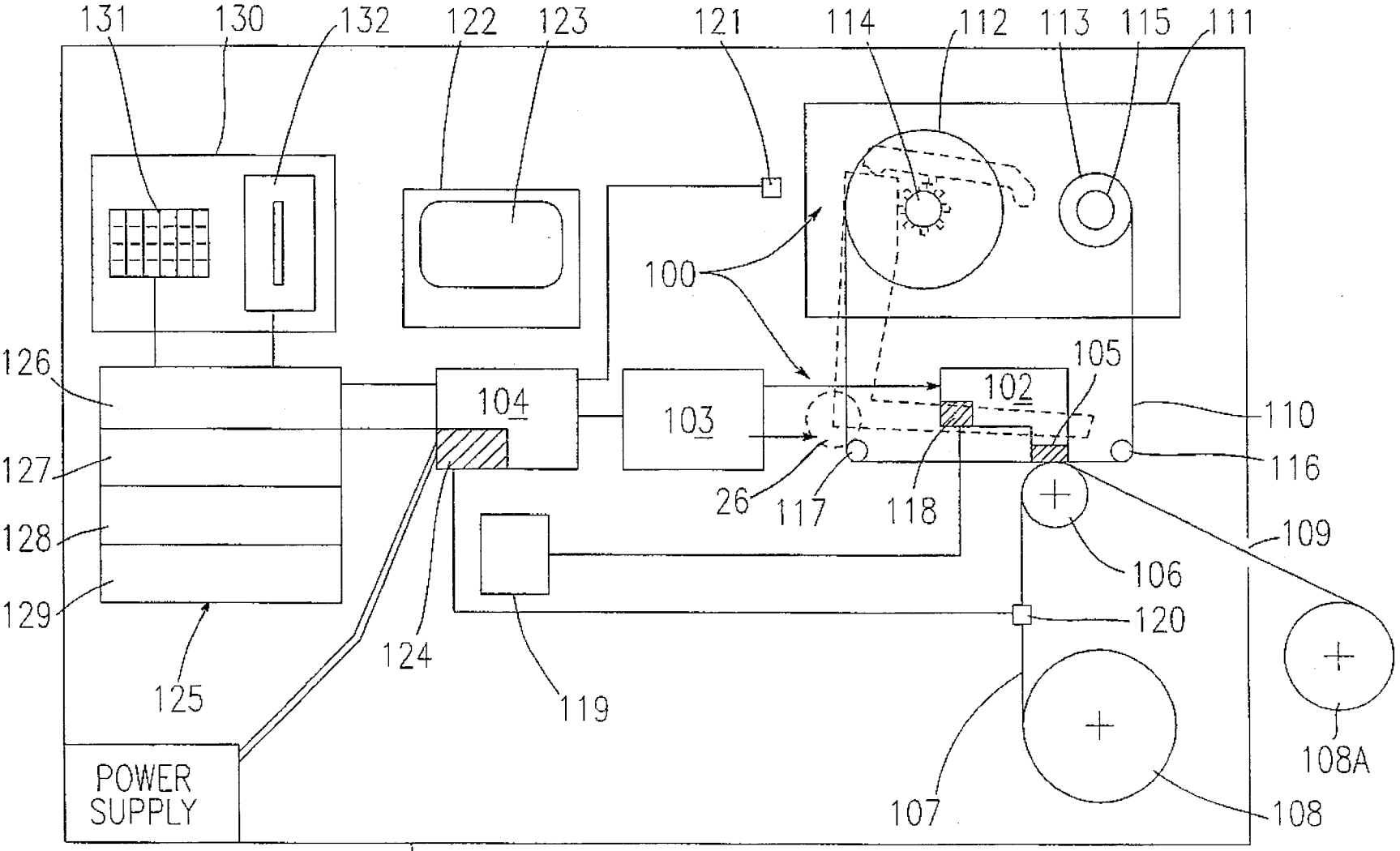
FIG. 3 shows a general embodiment of a thermal printer.

The medium to be printed (107 in FIG. 3) can also be unwound from a roll or spool (108 in FIG. 3) and can be wound up, if necessary, on another roll or spool (108A in FIG. 3). The medium to be printed can typically be divided into individual fields to be printed, or the medium can also contain labels, for example, which do not need to be printed all the way to their front and rear edges. To this extent, therefore, there can typically be spaces which remain unprinted between succeeding, identical printed segments in the direction of transport 13 of the ribbon and of the medium being printed.

In the unprinted sections of the medium being printed, that is, when no printing is being done, a continual advancement of the thermal transfer ribbon 4 would represent an unjustified expense. In other words, with a continual advancement of the thermal transfer ribbon 4 during periods when no printing is being performed, there would typically be portions of the thermal transfer ribbon 4 which would not have therefore been used, thus resulting in wasted ribbon 4. The present invention teaches that unnecessary consumption of the thermal transfer ribbon 4 can be reduced, or even possibly eliminated, by stopping advance of the thermal transfer ribbon 4 whenever the medium to be printed, which is in constant motion, does not need to be printed at a given point.

The present invention teaches that this comparatively sudden stopping of the thermal transfer ribbon 4 after printing the "last line" can preferably be accomplished by means of a stopping device 14. In general, to print in a thermal transfer process, the printer basically requires a corresponding electronic control system with a computer. Because such a control system would essentially already have access to all the necessary data regarding the stopping and starting of printing, the existing control system can preferably also be used to control the stopping device 14. In other words, the existing control system could preferably be used to move the stopping device 14 into the operating position when the thermal transfer ribbon 4 need not advance, and to release the stopping device 14 once again when the medium to be printed has advanced to the point where the next area to be printed has arrived in the printing area 2.

The stopping device 14 can preferably also operate in conjunction with a slip clutch 15, (see FIG. 2) which is not illustrated or explained in any further detail herein, as slip clutches are generally well known. In the illustrated embodiment of FIG. 2, the driving side of the slip clutch 15 is driven by means of an endless drive element 16, e.g. a toothed belt, and by an electric motor 17. Because of the presence of the slip clutch, during a printing job, the electric motor 17 can essentially always remain turned on, so that the driving side of the slip clutch 15 is in constant rotation. The slip clutch 15 transmits the torque from its driving side to its driven side, on which the second spool 3 would generally be located. If the stopping device 14, however, or some other cause, such as jamming, were to abruptly interrupt the movement of the ribbon 4, the friction moment of the slip clutch 15 would essentially no longer suffice to transmit the driving force of the electric motor 17 to the driven side of the slip clutch 15, and the slip clutch 15 would consequently slip. Then, as soon as the stopping device 14, once again releases the first spool 1, the driven side of the slip clutch 15 could also move, and consequently the thermal transfer ribbon 4, unwound from the first spool 1, could be wound up again on the second spool 3.

For various reasons, one of which is to at least prevent a tearing of the thermal transfer ribbon 4 when it is stationary, during these stationary phases, the application pressure with which the thermal print head 9 is pressed against the counterpressure roller 8 should also preferably be overcome. This can be done in a simple manner, e.g. by pivoting an actuation element 18 (see FIG. 2) at the appropriate time, in the direction indicated by the arrow 19, under the control of the printer control system. The actuation element 18 can be connected in a manner not shown in any further detail to the pivoting arm 10, and consequently can drive the arm 10 in the same direction of rotation, whereupon the thermal print head 9 can be raised from the counterpressure roller 8.

In purely theoretical terms, of course, the counterpressure roller 8 could also be lowered away from the print head 9, but the first alternative is preferable for a variety of reasons. As discussed earlier, since the print head 9 is biased towards the counterpressure roller 8, a movement of the print head 9 against the biasing force would immediately neutralize the biasing force, while a movement of the counterpressure roller 8 away from the print head 9 would only gradually decrease the application force over a distance. On the other hand, if the counterpressure roller 8 was being biased into engagement with the print head 9, a preferred movement of the counterpressure roller might be desirable.

To provide a locking device in accordance with the present invention, the first spool 1 can preferably be non-rotationally connected to an externally-toothed wheel 20. Above the wheel 20, in the plane of the depicted embodiment, a locking tooth 21 can be provided for engaging with the teeth 20A (see FIG. 2A) of the toothed wheel 20. The locking tooth 21 can be held by a pivoting arm 22 and can preferably be manufactured as one piece with the pivoting arm 22. The pivoting arm 22 can preferably be pivoted around an axis 24 in the direction indicated by the double arrow 23, or that is, towards and away from the toothed wheel 20. During printing, the pivoting arm 22 would typically be in the angular position indicated in FIG. 1, that is, an unengaged position with respect to the toothed wheel 20. The arm 22 can preferably be retained in this inactive position by means of a holding device, such as a regulatable locking element 25. By means of a drive mechanism 26, which can preferably be controlled by the control system of the printer, the pivoting arm 22 can be moved into the active position shown in FIG. 2.

In the illustrated embodiment, this movement takes place indirectly, i.e. the locking element 25 is located on a lever 27, which lever 27 is preferably mounted so that it can pivot, and which lever 27 can be adjusted by means of a cam drive mechanism 28 (see FIG. 2), which cam drive mechanism 28 can be moved by the drive mechanism 26. The lever 27 is preferably an angular lever having legs 34 (shown in FIG. 2) and 35 (shown in FIG. 1). The upper end of leg 35, in the drawing, preferably forms the locking element 25. As soon as this upper end is lowered, the pivoting arm 22 follows this movement, and the locking tooth 21 can thereby be engaged in the next tooth space 29, as shown in FIG. 2. The pivoting arm can preferably follow the downward movement of the lever 27 due to gravity, however, if alternative positioning of the printing arrangement is desired, a biasing device 55 (see FIG. 2*a*) could preferably be provided to bias the arm 22 towards the toothed wheel 20.

The lever 27 can rotate around an axis 30. In the vicinity of the angle corner of the lever 27, that is, in the vicinity of the drive 26, there can preferably be an open-edged slot 31 (see FIG. 2) in which a pin 32 can be engaged. Both the slot 31 and the pin 32 are components of a cam drive mechanism 28. The pin 32 can preferably be attached to a drivable rotational element 33. This rotational element 33, in accordance with one embodiment of the present invention, can preferably execute only approximately one-half of a revolution to move the pin 32 through an arc of about 180 degrees, and thereby move the lever 27. Thus, in accordance with the depicted embodiment, to lower the lever 27 from the position shown in FIG. 1 to the position shown in FIG. 2, the rotational element 33 can be rotated 180 degrees in a first direction which could be either a clockwise or counterclockwise direction. Then to move the lever 27 back into its raised position, the rotational element 33 could be moved in a reverse direction 180 degrees. Alternatively, a raising movement could be brought about by a further 180 degree movement in the first direction. Thus, a reversing motor could be used as the drive 26 to provide a clockwise-counterclockwise movement as discussed above. Alternatively, a one-directional motor could be used as the drive 26 to provide only one of: a clockwise movement, or a counterclockwise movement, that is, provided that the slot 31 could accommodate the pin 32 throughout the full circumferential motion of the pin 32.

The slot 31, as shown in FIG. 2 for example, can preferably extend approximately in the longitudinal direction of the leg 34 of the angular lever 27 hinged to the axis 30. Consequently, the locking element 25 can preferably be located on the free leg 35 (see FIG. 1). The pivoting arm 22, with the locking tooth 21, as shown in the illustrated embodiment, can preferably be a simple pivoting lever which has a projection, such as a preferably convex support element 36, on its free end. This support element 36 can preferably be in contact on top with the end surface of the free leg 35 which forms the locking element 25.

As shown in FIG. 2, the hinged leg 34 of the pivoting angular lever 27 can preferably extend beyond the axis 30. The extending arm which is thereby formed is designated by 37. This arm 37 can preferably be hook-shaped on its free end, and the hook 38 can essentially be formed by a slot 39 which can be open on the side. A bolt 40, which can be fastened to the pivoting arm 10 can be engaged in this slot 39. The pivoting arm 10 can in turn preferably be engaged to the print head 9. It could also be conceivable that a direct connection between the print head 9 and the end 37 of the lever 27 could be provided.

When the rotational element 33 with the pin 32, starting from its angular position illustrated in FIG. 1, is rotated by approximately 180 degrees, e.g. in a counterclockwise direction, the pin 32, which is engaged in the slot 31, can pivot the lever 27 also in the counterclockwise direction around its axis of rotation 30. As a result, on one hand by means of the connection 39, 40, the thermal print head 9 can be raised from the counterpressure roller 8 and the pressure on the medium to be printed and the thermal transfer ribbon 4 in the printing area 2 can be neutralized. In addition, the locking element 25 can be lowered, whereupon the pivoting arm 22 can execute a pivoting motion in the direction indicated by the arrow 23. Thus, while the pressure is being released there can be an essentially simultaneous engagement of the locking tooth 21 in a next available tooth space 29, as shown in FIG. 2. The stopping of the thermal printing ribbon 9 is therefore basically accompanied by the elimination of the pressure on the print head 9 in the printing area 2.

The control for the 180 degree rotational movement of rotational element 33 can preferably be achieved by means of a control cam 41, which can preferably be non-rotationally connected to the rotational element 33, and a sensor 43 (see FIG. 2A), e.g. a sensor which could possibly operate on an optical principle, which can preferably sense the two radial edges of the control cam 41. In this area, therefore, there is a corresponding control unit for the drive motor 26 of the rotational element 33. In other words, a sensor can preferably be provided for indicating when the cam 41 has attained a 180 degree rotation to thereby stop movement of the cam 41 and the lever 27.

Alternatively, instead of the cam 41 and drive 26, a solenoid switch could possibly also be used in another possible embodiment of the present invention, to move the lever 27. As such, a switching of the solenoid between an on and off position could be used to move the lever 27 between the two positions as illustrated in FIGS. 1 and 2. Such solenoid switches are generally well known and are not-discussed in any further detail herein.

Figure 4:
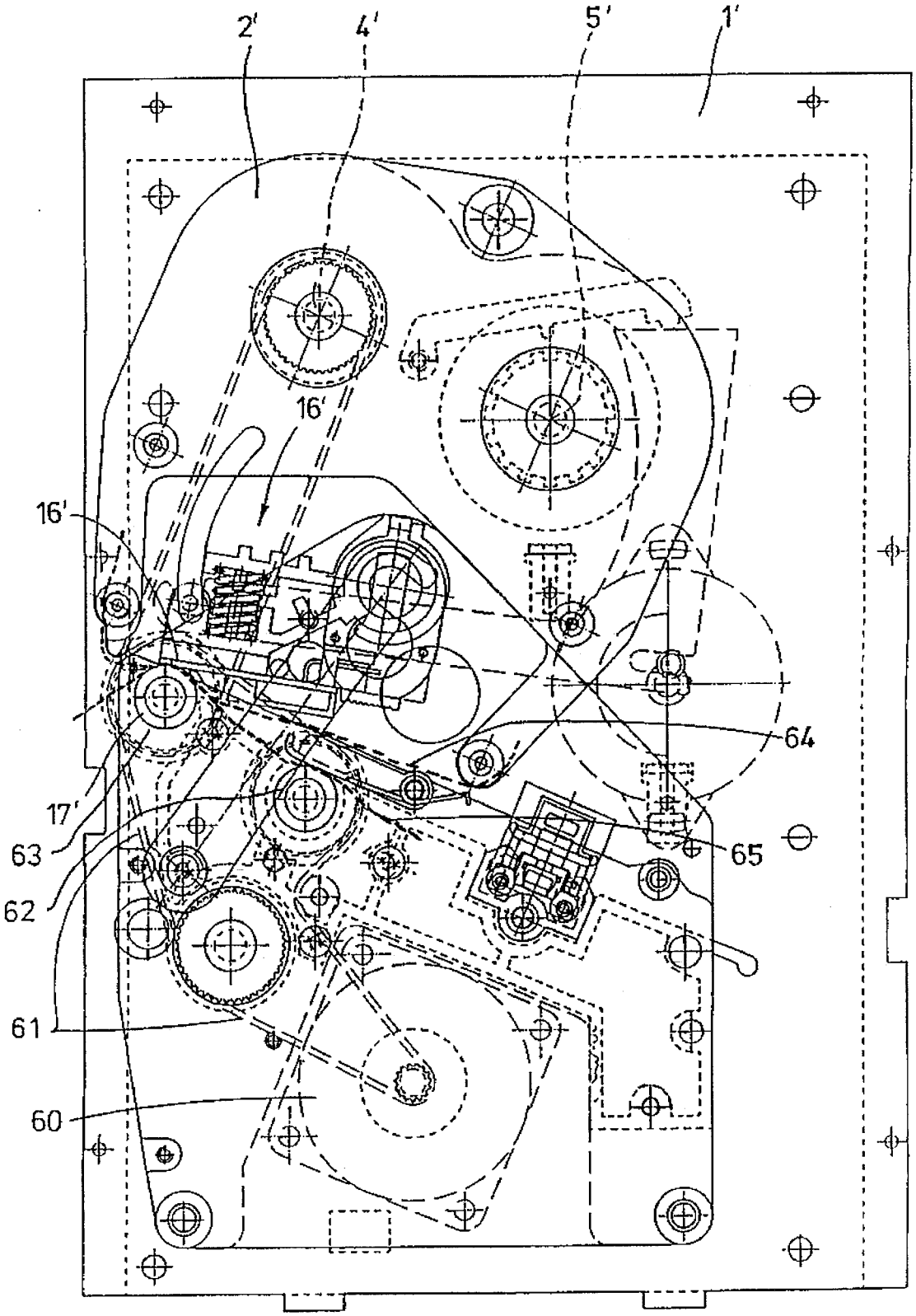
FIG. 4 shows a side view of an alternative embodiment of a printer with an inserted cassette.

As depicted in FIG. 4, a drive motor 60 could be provided for feeding the printing ribbon 64 and the label material 65 through the area adjacent the print head 16'. In essence, the counter pressure roller 17' could be provided to move the label material 65 and printing ribbon 64 past the print head 16' when the counterpressure roller 17' is engaged with the print head 16'. However, when the print head 16' is disengaged from the counterpressure roller 17', there would be no further movement of print ribbon 64 or label material 65, and thus, the further roller 62 is also provided to enable a continuous feed of the label material 65. A drive belt 61 could preferably be provided to drive the rollers 17' and 62 by means for pulley devices 63 which can be non-rotatably connected to the rollers 17' and 62.

One type of thermal printer which could be configured with the stopping and lifting arrangement in accordance with the present invention is depicted in FIG. 3. In FIG. 3, the stopping and lifting arrangement is schematically represented by the reference number 100. The thermal printer 101 has a thermal print head 102 which can be electrically connected by means of a control circuit 103 to a computer processor 104. On the underside of the thermal print head 102 there are preferably electrically activated heating elements 105, which can be maintained in contact against a counterpressure roller 106. Preferably, the heating elements 105 can be oriented in a straight line lying perpendicular to the plane of the drawing and aligned with a longitudinal axis of the counterpressure roller 106.

A label strip 107 can be introduced between the heating elements 105 and the counterpressure roller 106. As the label strip 107 is printed, it is preferably unrolled by means of a label strip payoff reel 108, and can, if desired be taken up by a take-up reel 108A. After having been printed with the desired printing information, the label strip 107 can be output by means of an outlet opening 109 of the thermal printer 101. The above described thermal printer apparatus 101, including the print head 102, the heating elements 105 and the label strips 107, are generally known in the art and are not described in great detail herein.

The label strip 107 can consist of temperature-sensitive paper which is printed as it is moved past the pin-shaped heating elements 105. Appropriate ones of the heating elements 105 can be heated as necessary, and the areas of the paper, or label strip 107, to which heat is applied can thereby be darkened at the desired points. Alternatively, the label strip 107 can also be conventional writing paper. With such conventional writing paper, it is generally necessary to introduce a thermal transfer ink ribbon 110 between the label strip 107 and the heating elements 105 of the thermal print head 102. The thermal transfer ink ribbon 110 can essentially be coated with temperature sensitive ink, which can preferably be configured to melt at the points where it is moved past activated, or heated, heating elements 105. The melted ink then can adhere to the conventional label strip 107 to thereby form a desired printed image.

Such a thermal transfer ink ribbon 110 can preferably be housed in a cassette 111, which cassette 111 can preferably have a payoff reel 112 and a take-up reel 113 therein. The cassette 111 can generally be positioned within the thermal printer 101 by means of devices 114, 115 which are configured to fit into, or hold the reels 112, 113. The thermal printer 101 can also preferably have deflector rollers 116, and 117 disposed within the printer housing, to direct the path of the ink transfer ribbon past the print head 102 and heating elements 105. Such deflector rollers 116, 117 essentially make certain that the thermal transfer ink ribbon 110 is moved past the heating elements 105 at the optimum angle for transferring the ink to the paper, or label strip 107, in which the ribbon 110 is in contact at the print head 105. Such thermal transfer ink ribbons, and the manner of transferring the ink thereon, are also considered to be well known in the art. One type of cassette which could be used in conjunction with the present invention is discussed further herebelow with reference to FIGS. 4–16.

The thermal print head 102 can be equipped with a temperature sensor 118 to transmit an analog electrical signal corresponding to the temperature of the thermal print head 102 to an analog-digital (A-D) converter 119. This A-D converter can then digitize the temperature signal and transmit the digitized signal to the processor 104.

The processor 104 can also preferably be connected to a paper sensor 120, which can be, for example, a photoelectric cell which detects the presence of a label strip 107, and reports the presence or absence of a strip to the processor 104. Alternatively, the paper sensor 120 can also be configured as a laser scanner which is capable of reading bar codes. If such a scanner were to be used, bar code markings, indicative of the type of paper being used, could be provided on the paper strips. The bar code markings on the label strip 107 could then be automatically read by the scanner to provide the processor 104 with information not only about the presence of the label strip material, but also about the type of label strip material present. These data can be retrieved by the processor 104 for further processing.

The processor 104 can also preferably be electrically connected to an ink ribbon sensor 121. This ink ribbon sensor 121 can be designed either as a photoelectric cell, only to detect the presence of the thermal transfer ink ribbon 110, or, as discussed above for the paper sensor, can be designed as a laser scanner which can read the bar codes applied to the cassette 111, to thereby provide information on the material, or type of thermal transfer ink ribbon 110 being used. Photoelectric cells and laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 104 can preferably be connected to an optical data output medium 122. Such an output device 122 could provide an LCD screen 123 for displaying variables which the operator may have to adjust, or to alternately display control commands for operation of the printer. Various alternative output devices would also be within the skill of the artisan.

The processor 104 can also preferably be equipped with a working memory 124, the capacity of which is preferably sufficient to buffer the control data supplied both by a read/write memory 125 connected to the processor 104, and also by the paper sensor 120 and by the ink ribbon sensor 121 during a printing process. The processor 104 can preferably use this information to control the label printer 101. With such a buffer, or working memory 124, the processor could essentially operate at higher speeds as data transfer between the read/write memory 125 and the processor 104 would not need to continuously take place.

The read/write memory 125 can essentially be partitioned into several areas depending on the features of the thermal printer. The example shown in FIG. 3 essentially depicts four memory areas 126 to 129, but more or less could be provided, with the possibility for future expansion as needed. The memory areas could be set up as provided below, but the following is meant as an example only, and various other set-ups would be well within the skill of the artisan.

A first memory area 126, could be used to store the information which is to be applied, or printed on the labels. A second memory area 127 could be used to store a data matrix corresponding to the various types of paper which are usable for the label strips 107. A third memory 128 could be used to store the printing speed, that can be set or selected by the operator, and a fourth memory area 129 could be used to store the ink ribbon data corresponding to the various types of paper of the specified label strip 107.

The number of data matrices stored in the second memory area 127 should preferably correspond to the number of types of paper of the label strips 107 which are specified for use on the particular printer. Each of these data matrices is indicative of the type of paper it describes, and can, for example, consist of an array of three rows of data, whereby the data in the first row could indicate the thermal print head temperatures, the data in the second row could indicate the printing speeds, and the data in the third row could indicate reference energy values. During printing, these reference energy values can be transmitted by the processor 104 preferably directly to the control circuit 103 to control the thermal energies to be generated by the thermal print head 102 in each of the individual heating elements 105 to. thereby produce an optimized print. For each data pair consisting of a thermal print head temperature and a printing speed, there is preferably a corresponding reference energy value for the paper being printed upon. Thus, when a temperature and a speed value are input, a reference energy value can clearly be determined and output.

The ink ribbon data contained in the fourth memory area 129 could essentially be described as a list consisting of three rows. The data in the first row could indicate the type of paper of the label strip 107 to be used. The data in the second row could have the values 0 and 1, whereby a "0" can mean that when the type of paper listed in the first row is being used for printing, no thermal transfer ink ribbon is necessary, and a "1" could indicate that an ink ribbon is necessary for printing. In the third row, there can either be a "0", which can indicate that when a particular type of paper is used, no special requirements need to be set for the material of the thermal transfer ink ribbon 10, or another digit, i.e., 1, 2, 3, etc. could indicate which type of ink ribbon must be used to print the specific type of paper.

The above described data arrays can preferably be read into the read/write memory 125 by means of a data input device 130. Such an input device 130 could essentially be a computer keyboard 131 and a card reader device 132, or in essence could essentially be any type of input mechanism which are Commonly used for entering data values into computers, i.e. a scanner.

During the installation of the thermal printer, the data matrices corresponding to the types of paper to be used can be read into the corresponding memory area, or in this example, the second memory area 127. Likewise, the ink ribbon data can be read into its corresponding memory area, or the fourth memory area 129 of the read/write memory 125. Then, when printing is to be done, the data to be printed on the label strip 107 can be input into its corresponding memory area, or the first memery area 126 by means of the input device 130, or computer keyboard 131 and the card reader 132.

The processor 104, via the LCD screen 123, can then preferably output a list of the types of paper that were read into the second memory area 127. The operator can then manually select the data matrix corresponding to the type of paper to be used. Further, the printer may also be set up so that the operator is given an opportunity to verify whether there is a data matrix already stored for the particular type of paper of the label strip 107. Thus, if necessary, the appropriate data matrix can then be read into the corresponding memory area, or second memory area 127 of the read/write memory 125. Alternatively, a label strip 107 of a paper with a data matrix already stored in the memory and displayed on the LCD screen 123 can be introduced into the thermal printer 101.

The processor 104 can then retrieve the data matrix corresponding to the type of paper selected, and can call up the corresponding ink ribbon data from the read/write memory 125, and store these data in its working memory 124.

By means of the LCD screen 123, the processor 104 can output a list of the possible printing speeds contained in the data matrix, and thus enable the operator to select a desired printing speed. If the operator does not select a speed, the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer 101, thereby provides an opportunity at the beginning of the printing process to select a printing speed, which printing speed can then be stored in the third memory area 128 of the read/write memory 125. After the selected data matrix has been read into the working memory 124, the processor 104 can preferably retrieve the value corresponding to the desired printing speed from the third memory area 128, and compare this value to the speed values contained in the data matrix. The processor 104 can then preferably automatically select the value from the data matrix which either corresponds to, or is closest to the selected printing speed.

By means of the temperature sensor 118, the processor 104 can measure the temperature of the thermal print head 102 and then select, from the data matrix, the temperature value corresponding to, or closest to this value.

From the data matrix, and using the above-chosen temperature and speed values, the processor 104 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 124 and specific to the type of paper, and on the basis of the data supplied by the ink ribbon sensor 121, the processor 104 can then check for the following conditions:

A) whether there is a "1" in the second row of the ink ribbon data (indicating that an ink ribbon is needed), and whether a cassette 111 for the thermal transfer ink ribbon 110 has been inserted; or B) whether there is a "0" in this position and no cassette 111 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 111 which has been inserted, or to insert the missing cassette 111.

The processor 104 can also check to see whether there is a "0" in the third row of the ink ribbon data list, or possibly another digit identifying a thermal transfer ink ribbon 110. On the basis of this value and the values supplied by the ink ribbon sensor 121, the processor 104 can check, if necessary, to see whether the correct thermal transfer ink ribbon 110 has been inserted. By means of an error message displayed on the LCD screen 123, or possibly by,an audible warning, the operator can preferably be requested to insert the correct thermal transfer ink ribbon 110 into the printer, if necessary.

Also, on the basis of the data supplied by the paper sensor 120, the processor 104 can preferably check to see whether a label strip 107 has been inserted. A warning signal can also be generated if a paper strip is not present, indicating to the operator that paper needs to be inserted.

The processor 104 can then retrieve the printing information read into the first memory area 126 of the read/write memory 125, and initiate the printing process. To initiate the printing process, the processor 104 will essentially transmit the printing information, the selected or specified printing speed, and the reference energy value selected from the data matrix to the control circuit 103 of the thermal print head 102. The control circuit 103, by means of electrical connections and driver circuits (not shown, but commonly known in the art), can then drive the counterpressure roller 106 to transport the label strip 107, as well as the thermal transfer ink ribbon 110, preferably by means of electric motors, not shown in the figure. The motor for driving the ink ribbon 110 would preferably be connected to the take-up reel 113. The control circuit 103 can also preferably start the printing process itself by activating the individual heating elements 105 as a function of the input and measured data.

In addition, the control circuit 103 could also control operation of the drive mechanism 26 as discussed earlier with respect to FIGS. 1 and 2, to thereby control the stopping device 14 and lift the print head 9, 102 from the counterpressure roller 8, 106.

The reference energy value determined from the printing speed and the thermal print head temperature essentially then controls the thermal energy generated by the heating elements 105. The thermal energy generated would preferably be greater, the higher the printing speed set, and the lower the measured thermal print head temperature. Preferably, the thermal energy can be controlled by changing the times at which a specified voltage is applied to the heating elements 105. Such heating elements 105 are preferably designed as resistance heating elements.

If the paper sensor 120 is configured as a laser scanner capable of reading bar codes, and if markings are applied to the labels in the form of bar codes which provide information on the type of paper used for the labels, the operation of the thermal printer 101 can essentially be automated because the type of paper for the labels need no longer be input manually by the operator, but the processor 104, by means of the paper sensor 120, can automatically identify which type of labels have been inserted. On the basis of the data received in this manner, the processor 104 retrieves the corresponding data matrix from the second memory area 127 of the read/write memory 125, and the ink ribbon data specified for the type of paper identified from the fourth memory area 129. Using these data, the thermal printer 101 can be controlled by the processor 104 as described above.

One type of cassette 111 for use in a printer such as the printer of FIG. 3 is depicted in greater detail with reference to FIGS. 4–16. In the printer depicted in FIG. 4, which essentially depicts the stopping arrangement as described earlier in FIGS. 1 and 2, in reverse image, a cassette 2' can be inserted into the printer 1' approximately perpendicular to the plane of the drawing. A rear wall 3' (see FIG. 9) of the printer 1' can preferably be penetrated by two externally-toothed shafts located at a lateral distance from one another, whereby for example the one shaft 4' can be connected to a drive motor, while the other shaft 5' can be a brake shaft connected to a slip clutch, as discussed previously. The lateral distance 6' (see FIG. 5) between the two shafts 4' and 5' can preferably correspond to the distance between the holes of the cassette 2', or the distance between the shafts 4' and 5'.

Figure 5:
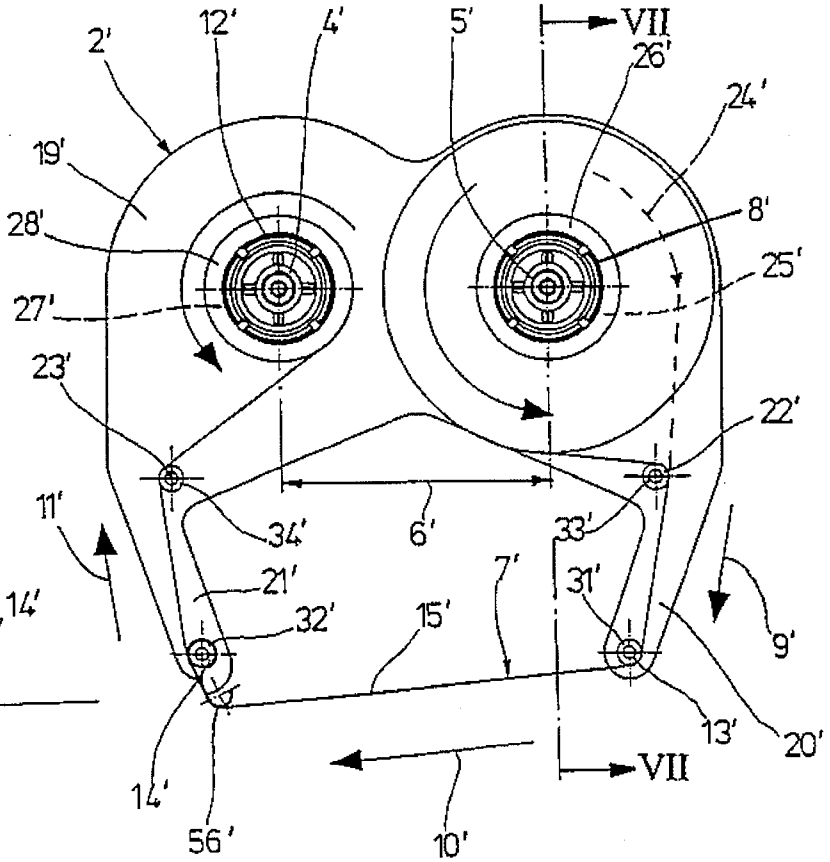
FIG. 5 is a plan view of a somewhat-modified cassette.
Figure 6:
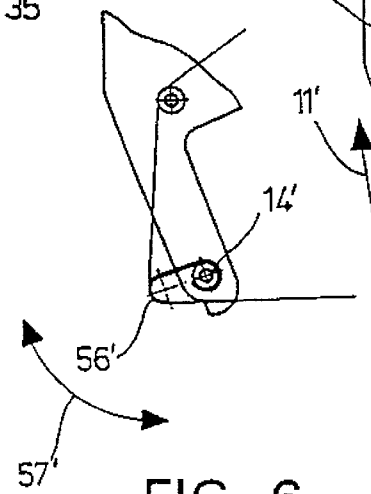
FIG. 6 is a detail of FIG. 5, with the guide plate in another position.
Figure 7:
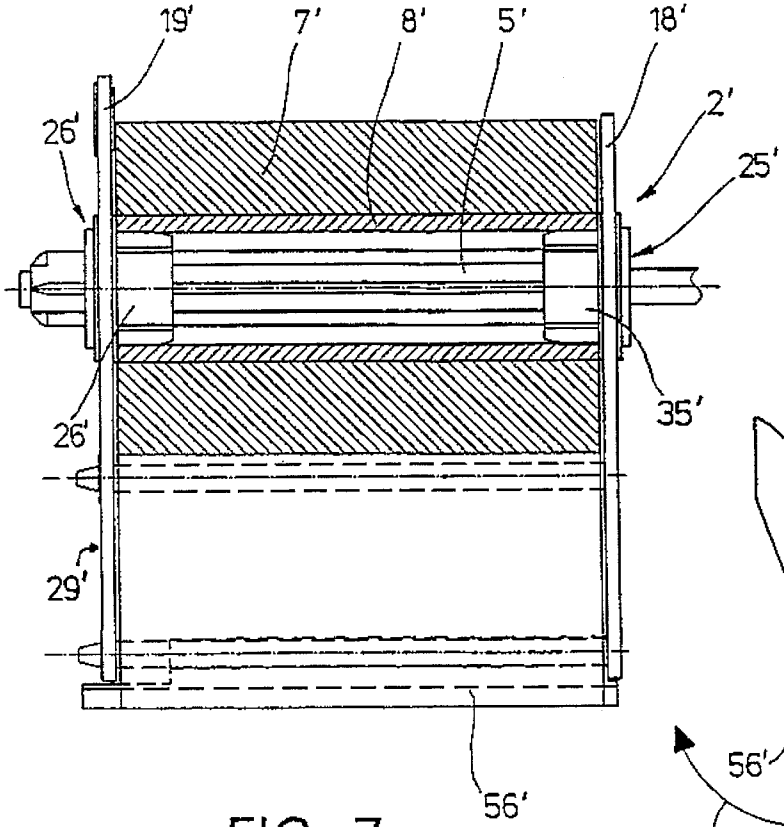
FIG. 7 is a cross section taken along line VII—VII in FIG. 5.

As shown in FIGS. 5 and 7, the cassette 2' holds a tape 7' which can preferably be on a core 8', preferably a core made of cardboard, while other materials arc usable as well. When this tape 7' is to be paid out in the direction indicated by the arrows 9', 10', and 11', in FIG. 5, the tape 7' and the core 8' are first assigned to the brake shaft 5'. When the drive shaft 4' is driven, the ribbon 7' can be unwound from the core 8' and wound up on another core 12', which core 12' can preferably be penetrated by the drive shaft 4'. The ribbon 7' can also be deflected by means of deflectors 13' and 14' on the lower end of the cassette in FIG. 5. The segment of the ribbon 7' located between these deflector elements 13' and 14' can form the working, usable strand 15' of the ribbon 7'. This working strand 15' can preferably be guided between a printing head 16' of the printer 1' and a printing roller 17' (FIG. 4).

Figure 10:
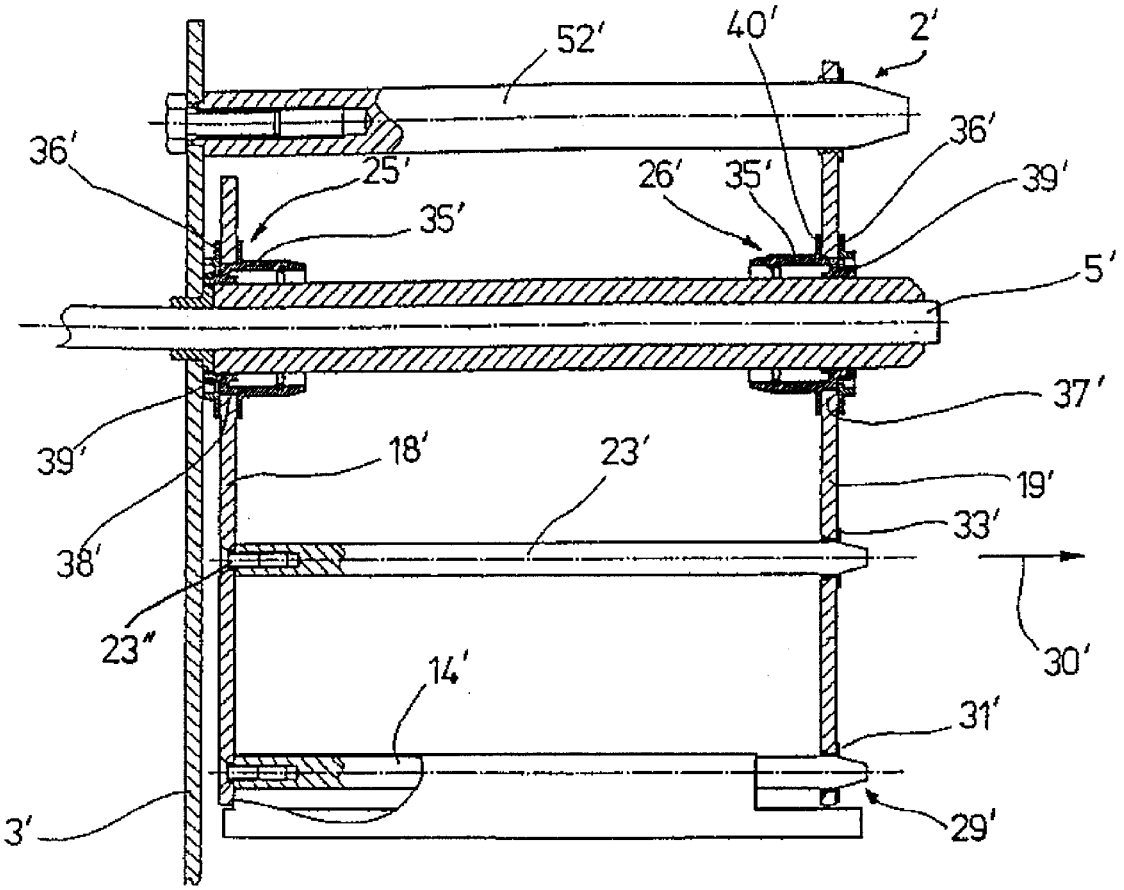
FIG. 10 is a cross section through the cassette illustrated in FIG. 5, whereby the cross section is essentially the same as the cross-section illustrated in FIG. 8.

The essential components of the cassette 2' can essentially be two parallel housing halves 18' and 19' as shown in FIG. 7. The housing halves 18' and 19' can essentially be C-shaped, as shown in FIG. 5, so that cassette arms 20' and 21' are formed. The two deflector elements 13' and 14', which can be pins, pointed on the free end thereof, as illustrated in FIG. 10, for example, can preferably be attached to the free ends of the arms.

Approximately at the transition to each arm 20' and 21', there can preferably be respective additional deflector elements 22' and 23' for the ribbon 7'. Also as illustrated in FIG. 10, these additional deflector elements 22' and 23' can preferably be pointed pins which can be fastened to the housing half 18' by means of a screw 23", preferably to the housing half which corresponds to the rear wall 3'. The ribbon 7' can either be unwound as shown by the solid line in FIG. 5, or, alternatively, can be unwound as shown by the dotted line 24' in FIG. 5. As such, the cassette 2' can be used both for an externally-wound ribbon or tape 7' and for an internally wound ribbon.

Additional important elements of the cassette 2' include at least one core on each shaft 4' and 5', respectively. But in all the embodiments, instead of one long core on each shaft 4' and 5', there can alternatively be, two short, coaxial cores 25' and 26' or 27' and 28' respectively, as shown in FIGS. 5 and 7. Each pair of cores 25', 26' and 27', 28' can hold the ends of a tape core 8' or 12' respectively. The cores 25' and 27' can be mounted so that they can rotate in the first housing half 18', and the cores 26' and 28' so that they can rotate in the second housing half 19'. Each core 25' to 28' can be designed in two parts as illustrated in FIG. 10, for example, which facilitates the installation of the cores in the housing 29'. This housing 29', as described above, can be formed from the two housing halves 18' and 19' and the deflector elements 13', 14', 22' and 23', preferably formed by pins.

Figure 8:
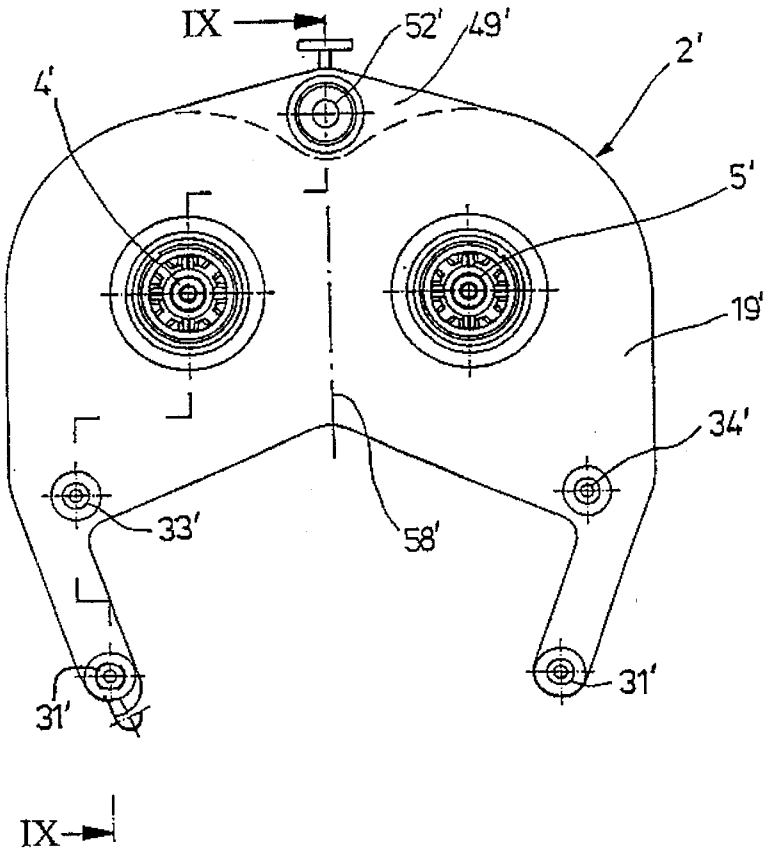
FIG. 8 is a plan view of the cassette illustrated in FIG. 4.

The housing half 19' can be pulled off the pins 13', 14', 22' and 23' (shown in FIG. 5) in the direction of the arrow 30' (shown in FIG. 10), and can preferably be held on the free ends of the pins essentially only by clamping. The deflector elements 13', 14', 22' and 23' can provide for a correct positioning of the housing half 19', and can each be preferably held by a bushing, preferably a plastic bushing 31', 32', 33' and 34' as shown in FIG. 5 and 8, in each opening of the second housing half 19'.

In an alternative embodiment of the apparatus, the bushings 31'–34' could be optional if the surfaces of the pins 13', 14', 22' and 23' or of the adjoining orifices through which the pins pass, had a surface treatment which performed in the same manner as the bushing 31'–34'. For example, a plastic, or possible teflon coating could be applied to form a wear layer with an appropriate friction coefficient that facilitated movement of the housing halves 18' and 19' along the pins 13', 14' 22' and 23'.

Figure 12:
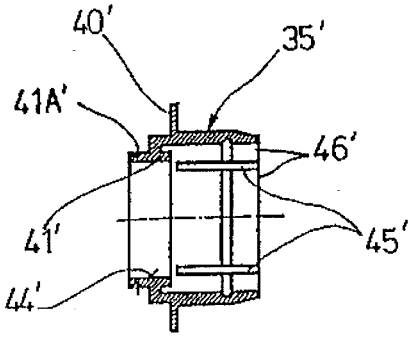
FIG. 12 is a longitudinal center section through the base body of FIG. 11.
Figure 15:
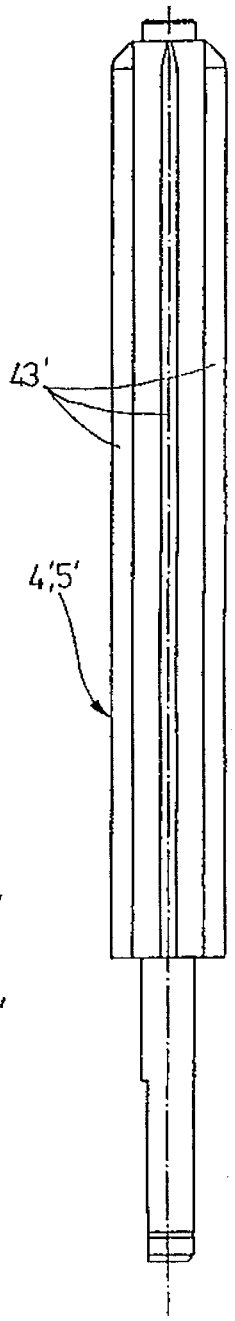
FIG. 15 is a plan view of the drive shaft corresponding to the cores.
Figure 14:
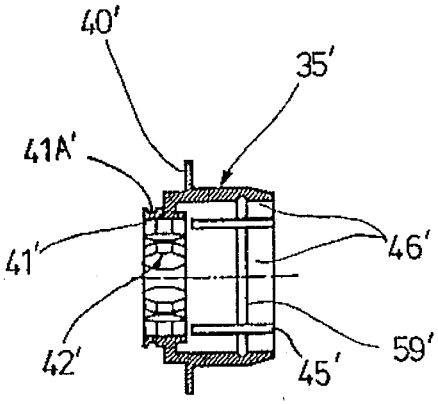
FIG. 14 is a longitudinal center section through the base body illustrated in FIG. 13.

As shown in FIG. 10, for example, all the cores 25' to 28' can be designed in two pieces, and each of them can be formed by a sleeve-shaped base part 35' and a ring-shaped retaining part 36' which can be connected to the cores. The sleeve-shaped base parts 35' can be inserted in corresponding holes 37' and 38' in the housing halves 19' and 18' respectively. The ring-shaped retaining part 36' can be inserted onto the projecting end, and can be axially secured by means of a retaining element 39', preferably a retaining ring, which retaining element 39' could preferably snap into a groove 41A' as shown in FIGS. 12 and 14. Each sleeve-shaped base element 35' can be in contact by means of an external shoulder 40' (see FIGS. 12 and 14) against the inside surface of the corresponding housing half 18' or 19' respectively. Opposite, on the outside of each housing half 18' or 19', the ring-shaped retaining part 36' can preferably axially secure each base element to the housing half 18' or 19' respectively.

Figure 11:
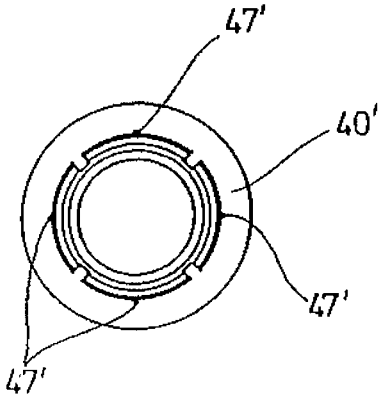
FIG. 11 is a plan view on an enlarged scale of the base of one of the two cores.

FIGS. 12 and 14 show in particular that the base part 35' becomes smaller in a stepped fashion, whereby the ring-shaped retaining part 36' can be pressed onto the smaller sleeve-shaped partial piece 41' as shown in FIG. 10, and the retaining element 39' can be locked to the retaining element 36' via notch 41A'. This partial piece 41' can be elongated into the inside of the core, as shown in FIGS. 12 and 14. In any case, on the smaller, sleeve-shaped partial piece 41' of the first cores 26' and 28', there can be internal teeth 42' (see FIGS. 13 and 14) which can correspond to the external teeth 43' on the shafts 4' and 5' respectively, see FIGS. 15 and 16. Such internal teeth could also be provided on all the sleeve-shaped base parts 35', but the embodiments specify that the sleeve-shaped base parts 35' of the second cores 25' and 27' have a hole 44' with a preferably smooth inner surface, as shown in FIGS. 11 and 12. The free ends of the teeth 43' of the shafts 4' and 5' can then be in contact with this smooth inner surface.

Figure 13:
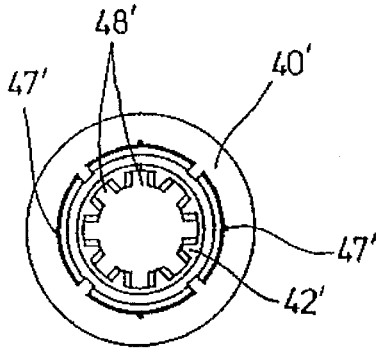
FIG. 13 is a plan view of the other base body of the cores.
Figure 16:
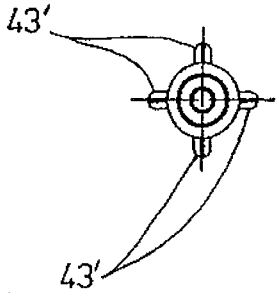
FIG. 16 is a plan view of the drive shaft illustrated in FIG. 15, from the right.

FIGS. 12 and 14 also show that the sleeve-shaped base parts 35' can be provided in the vicinity of their larger diameter with slots 45', thereby forming flexible tabs 46'. FIGS. 11 and 13 show that the flexible tabs 46', of FIGS. 12 and 14, can each have a radially projecting retaining element 47' on the outside, preferably in the form of a small radial strip. This can improve the frictional and interlocking connection between the cores 25' to 28' and the tape cores 8' and 12' respectively. To maintain the clamping action between the tabs 46' and the tape cores 8' and 12', the tabs 46' can be permanently pushed radially outward by a retaining ring (not shown) which can be inserted in an internal groove 59'. As shown in FIGS. 13 and 16, there can be a larger number, e.g. twice the number of locator grooves 48' than the number of teeth 43', i.e. eight grooves 48' as compared to only four teeth 43'.

Figure 9:
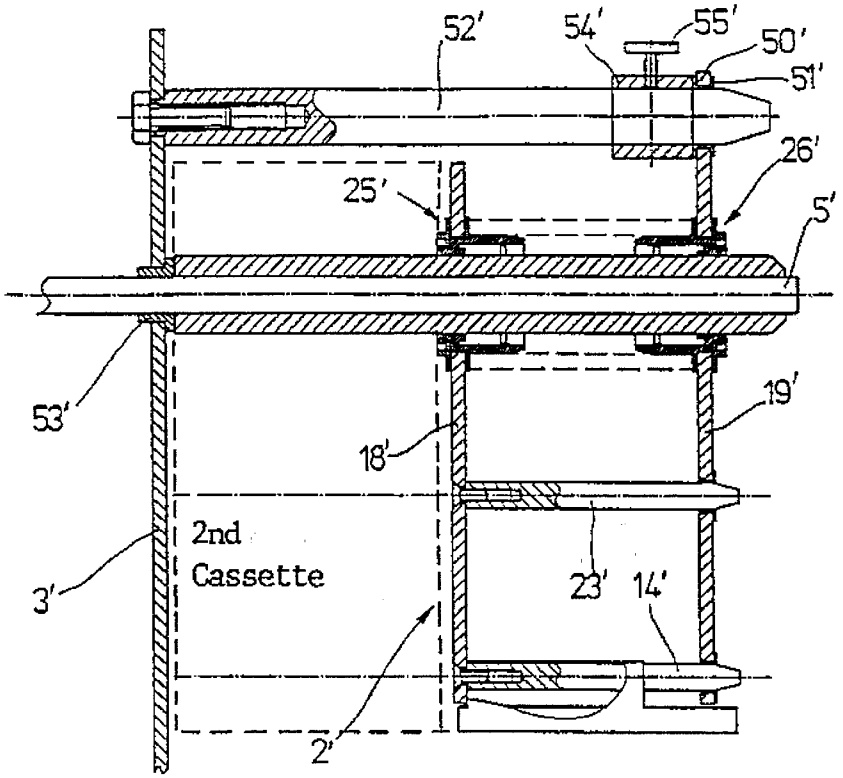
FIG. 9 is a cross section taken along line IX—IX in FIG. 8.

The cassette 2' illustrated in FIG. 10 is intended for relatively wide tapes 7'. But it is also possible to install narrower tapes 7' in this cassette 2', because the second housing half 19' can be mounted so that it can move on the pin-like deflector elements 13', 14', 22' and 23' and can be held in each position by friction. But if the second housing half 19', starting from its position in FIG. 10, is moved to the left toward the first housing half 18', the free ends of the pins on the right project beyond the housing half 19'. If this is unacceptable for any reason, or at least if it is undesirable, shorter pins can be used instead. A change-over from long pins to short pins can essentially be performed very easily, because the pins are simply screwed or bolted onto the first housing half 18'. FIG. 9 shows one embodiment with short pins or deflector elements 13', 14'; 22', 23'.

Otherwise, however, this embodiment of FIG. 9, is designed similarly to the cassette 2' illustrated in FIG. 10, with essentially only one slight difference, namely that the shape of the housing half 19' of FIG. 9, on its upper end, differs from the shape of the cassette illustrated in FIG. 5. In the embodiment of FIG. 9, the housing half 19' can be provided on its upper end with a bulge 49' (see FIGS. 8 and 9) in which there is a passage 50'. In the latter case, a bearing bushing 51', preferably made of plastic, is inserted. When this cassette is inserted into the printer 1', a locator pin 52' located on the rear wall 3' of the printer 1' can be engaged in the hole of the bearing bushing 51'. The cassette 2' illustrated in FIGS. 8 and 9 can be securely fixed in the printer 1' by means of this locator pin 52' and the two shafts 4' and 5'. To facilitate the insertion of the cassette 2', the free end of the locator pin 52' can preferably be somewhat pointed. As shown in the accompanying figures, the same can be true of the shafts 4' and 5'. The shafts 4' and 5' can also each run through a bearing bush 53' in the wall 3'. The bearing bush 53' in the wall 3' is preferably used for the axial and radial support of the shafts.

Because the cassette 2' illustrated in FIG. 9 is narrower than the cassette 2' in FIG. 10, the thickness of which equals approximately the length of the shafts 4' and 5', to the extent that the shafts 4' and 5' project beyond the wall 3', the precise position of the cassette 2' with respect to the printer 1' or its wall 3' must be specified by suitable means. One possibility is to place a sliding collar 54' with a set screw 55' over the locator pin 2'. It is easy to see that by pushing the sliding collar 54' toward the left, i.e. toward the wall 3' the stop formed by the sliding collar can be moved, and thus the cassette 2' can be moved back closer to the wall 3'. On the other hand, as shown in FIG. 9, it could also be possible to install two cassettes 2' (one of which is shown only schematically) next to one another in the printer 1', whereby each cassette can be loaded with an individual printing ribbon, e.g. with ribbons of different colors.

It is also possible first to print any labels or similar material with the cassette 2' in the position illustrated in FIG. 9, and then to push the cassette 2' all the way to the left, to then apply a second impression next to the first impression on the material being printed.

In the vicinity of at least one of the deflector elements 13', 14' in the embodiment illustrated,in FIG. 5, on the deflector element 14', there can preferably be a guide plate 56' which can be pivotably mounted on this deflector element 13' or 14', so that the guide plate 56' can pivot in the direction shown by the double arrow 57'. The guide plate 56' can preferably be clamped in its respective pivot position. The working position of the guide plate 56' is shown in FIG. 5. The usable strand 15' can thereby be pulled out beyond the free end of the cassette arm 21'. If, on the other hand, the guide plate 56' were to be moved into the angular position illustrated in FIG. 6, the strand 15' would not project downward beyond the free end of the housing 29', but if necessary, would project laterally beyond the outside of the cassette arm 21'. But that is irrelevant when the cassette 2' is installed in the printer 1', in terms of a danger of damage to the ribbon. By pulling the left end of the usable strand 15' out of the cassette 2', as shown in FIG. 5, the printing roller 17' (shown in FIG. 4) could be wrapped over a somewhat greater angle, thereby increasing frictional engagement between the printing roller 17' and the strand 15', which would be advantageous for printing at a high ribbon speed.

Because the cassette 2' is symmetrical along a longitudinal center plane 58' (FIG. 8), it can be used as a reversible cassette, i.e. after the ribbon 7' has run all the way through, the cassette 2' can preferably be simply be turned over like known audio cassettes, and the ribbon 7' can be run through once again. For such reversibility, a guide plate 56' could preferably also be required on the cassette arm 20'. Either a guide plate 56', as shown in FIG. 5 and 7, can be attached to both cassette arms 20' and 21', or the guide plate 56' can be switched from one cassette arm to the other, so that it can be removed from the cassette arm 21' and pushed onto the cassette arm 20' after the cassette 2' has been turned over.

The cassettes 2' described above can be assembled and disassembled easily. In particular, the cassette 2' can be inserted into the printer 1' easily as a result of the design of the shafts 4' and 5' and the corresponding cores 25' to 28' in a self-locating mechanism, whereby the ease of insertion can be further increased if there are twice the number of locator grooves 48'.

One feature of the present invention resides broadly in a printer with a liftably mounted print head 9 which can be applied by the force of a spring against a counterpressure roller 8, whereby the active strand 7 of a printing ribbon 4 and a medium to be printed run between the print head 9 and the counterpressure roller 8, on which there is a device to neutralize the application pressure between the counterpressure roller 8 and the print head 9 when the printing ribbon 4 is stationary, characterized by the fact that by means of a printer control system, a stopping device 14 for the printing ribbon 4 can be moved into an active position when the printing ribbon 4 is stationary.

Another feature of the invention resides broadly in the printer, characterized by the fact that the printing ribbon 4 is unwound from a first spool 1 and can be indirectly stopped by stopping the first spool 1, whereby the stopping device 14 interacts with the first spool 1.

Still another feature of the invention resides broadly in the printer, characterized by the fact that the printing ribbon 4 is wound up on a second spool 3 and that there is a slip clutch 15 between a drive mechanism 17 for the printing ribbon 4 and the spool 3 driven by the drive mechanism 17 for the printing ribbon 4.

Yet another feature of the invention resides broadly in the printer, characterized by the fact that the first spool 1 is non-rotationally connected to an externally-toothed wheel 20, corresponding to which there is a locking tooth 21 which can be engaged by means of the control system.

Still yet another feature of the invention resides broadly in the printer, characterized by the fact that the locking tooth 24 is located on a pivoting arm 22, which can be held in an inactive position by means of a controllable locking element 25.

Yet still another feature of the invention resides broadly in the printer, characterized by the fact that the locking element 25 can be moved by means of a controllable drive mechanism 26 from its engaged position into a disengaged position and vice-versa.

Another feature of the invention resides broadly in the printer, characterized by the fact that the locking element 25 is located on a lever 27 which is mounted so that it can pivot and which can be adjusted by means of a cam drive mechanism 28 which forms the controllable drive mechanism.

Still another feature of the invention resides broadly in the printer, characterized by the fact that a pin 32 attached eccentrically to a drivable rotational element 33 is engaged in a slot 31, which is located on the pivoting lever 27 at some distance from the axis of rotation 30 of the pivoting lever.

Yet still another feature of the invention resides broadly in the printer, characterized by the fact that the pivoting lever 27 is an angular lever, and the slot 31 is located in the vicinity of the angle corner, extending approximately in the longitudinal direction of the hinged leg 24, whereby the free leg 35 supports or forms the locking element 25.

Still yet another feature of the invention resides broadly in the printer, characterized by the fact that the free leg 35 of the angular, pivoting lever 27 assumes an approximately vertical position in the operating position, and its free end forms the locking element 25, whereby the pivoting arm 22 is supported on top on the free end of the angular lever.

Another feature of the invention resides broadly in the printer, characterized by the fact that the pivoting arm 22 is a one-armed lever, the free end of which has a preferably convex support element 27, whereby the locking tooth 21 is located between the pivot 24 and the support element 36.

Yet another feature of the invention resides broadly in the printer, characterized by the fact that the hinged leg 34 of the pivoting angular lever 27 extends beyond the bearing 30, whereby the extended arm 37 forms a part of the adjustment drive mechanism for the print head 9.

Some types of printers and the various components thereof which could be used in conjunction with the present invention are disclosed by the following U.S. Pat. No. 5,160,943 to Pettigrew et al., entitled "Printing Systems"; U.S. Pat. No. 5,055,858; to Koch, entitled "Thermal Print Head"; U.S. Pat. No. 5,023,628 to Koch, entitled "Thermal Head Mounting/Positioning Assembly"; U.S. Pat. No. 5,165,806 to Collins, entitled "Thermal Printer with Movable Drive Roll"; U.S. Pat. No. 4,326,813 to Lomicka and Heller, entitled "Dot Matrix Character Printer Control Circuitry for Variable Pitch Printing"; and U.S. Pat. No. 4,214,836 to Wang, entitled "Impact Print Head".

Some types of optical position scanners which could possibly be used for detecting movement of the cam means in accordance with the present invention are disclosed by the following U.S. Patents: U.S. Pat. No. 5,223,708 to Van Deventer, entitled "Alignment Insensitive Optical Position Sensor"; U.S. Pat. No. 5,218,199 to Miller, entitled "Optical Position Sensor Having Rigidly Fixed Read Head"; and U.S. Pat. No. 5,030,824 entitled "Optical Position Sensor Employing Encoder Delay".

Some types of solenoid actuators which could possibly be used for moving the lever means in accordance with the present invention are disclosed by the following U.S. Patents: U.S. Pat. No. 5,310,271 to Andou et al. entitled "Solenoid Actuator"; U.S. Pat. No. 4,480,827 to Shulz and Voecks, entitled "Pivotal Feed Head for Printing Apparatus"; and U.S. Pat. No. 4,300,758 to Peter, entitled "Reversing Mechanism for Duplex Printing/Paper Handling Apparatus for Cut Sheet Printing".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 32 562.9, filed on Sep. 24, 1993, having inventors Peter Schneider and Dirk Umbach, and DE-OS P 43 32 562.9 and DE-PS P 43 32 562.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printer for printing labels on a label material by transferring a printing substance from a printing ribbon to the label material, said printer comprising:

control means for controlling operation of said printer;

means for storing label material to be printed upon;

means for storing printing ribbon, the printing ribbon comprising a printing substance thereon;

print means for printing on the label material, said print means comprising at least one printing element, and said at least one printing element comprising means for transferring the printing substance from the printing ribbon to the label material;

means for feeding printing ribbon and label material to an area adjacent said at least one printing element;

means for actuating said at least one printing element to transfer printing substance from said printing ribbon to the label material to print on the label material adjacent said at least one printing element;

said means for feeding comprising means for conjunctively feeding printing ribbon and label material through the area adjacent said at least one printing element during at least first periods of operation of said printer;

means for inhibiting transport of said printing ribbon by said means for conjunctively feeding during transport of said label material by said means for conjunctively feeding during at least second periods of operation of said printer;

said means for inhibiting transport comprising means for stopping transport of said printing ribbon during transport of said label means during at least said second periods of operation to hold said printing ribbon stationary during at least said second periods of operation;

said means for storing printing ribbon comprising spool means having the printing ribbon wrapped therearound, said spool means being rotatable about an axis of rotation in said means for storing to unwrap printing ribbon from said spool means;

said means for stopping transport of said printing ribbon comprising means for inhibiting rotation of said spool means to prevent said ribbon means from being unwrapped from said spool means;

said spool means comprising first spool means for supplying printing ribbon;

said means for inhibiting rotation of said first spool means comprising:

a toothed gear;

means for non-rotationally connecting said toothed gear with said first spool means for united rotation of said toothed gear with said first spool means; and member means for engaging said toothed gear to inhibit rotation of said toothed gear and inhibit rotation of said first spool means; and said control means comprising means for controlling operation of said member means for engaging and disengaging said member means from said toothed gear.

2. The printer according to claim 1, wherein:

said print means comprises:

a print head, said print head comprising said at least one printing element;

counterpressure means disposed adjacent said print head; and biasing means for applying a biasing force to at least one of said print head and said counterpressure means to press said at least one of: said print head and said counterpressure means, towards the other of said print head and counterpressure means; and said printer further comprises:

means for providing said printing ribbon between said print head and said counterpressure means; and means for providing said label material between said printing ribbon and said counterpressure means.

3. The printer according to claim 2, further comprising:

said biasing means being configured for frictionally engaging said printing ribbon and said label material between said print head and said counterpressure means during said first periods of operation; and means for at least partially reducing said biasing force during at least said second periods of operation of said printer to at least partially reduce pressure between said print head and said counterpressure means, and to reduce frictional engagement of said printing ribbon and said label material between said print head and said counterpressure means.

4. The printer according to claim 3, wherein:

said means for feeding comprises means for pulling ribbon off of said spool means to rotate said spool means and unwrap printing ribbon from said spool means.

5. The printer according to claim 4, wherein:

said counterpressure means comprises a counterpressure roller, said counterpressure roller being mounted in a fixed position within said printer;

said feed means comprises first feed means for rotatably driving said counterpressure roller to feed said frictionally engaged label material and said printing ribbon through said area adjacent said at least one printing element during at least said first periods of operation;

said biasing means comprises biasing means for biasing said print head towards said counterpressure roller;

said means for at least partially reducing said biasing force comprises means for moving said print head away from said counterpressure roller to substantially reduce frictional engagement of said printing ribbon and said label material between said print head and said counterpressure roller and to substantially eliminate feed of said label material and said printing ribbon by said first feed means; and said feed means further comprises second feed means for feeding label material to said first feed means and through said area adjacent said at least one printing element independently of said first feed means during said second periods of operation.

6. The printer according to claim 5, wherein:

said printer further comprises take-up means for taking-up printing ribbon fed through said area adjacent said at least one printing element, said take-up means comprising:

second spool means for winding printing ribbon therearound;

drive means for rotatably driving said second spool means to wrap said printing ribbon around said second spool means; and slip clutch means disposed between said spool means and said drive means to minimize tensile stress on said ribbon means during at least said second periods of operation when said printing ribbon is prevented from unwrapping from said first spool means.

7. The printer according to claim 6, wherein:

said toothed gear comprises a circumference, and said toothed gear comprises a plurality of teeth spaced apart about said circumference thereof;

said member means for engaging said toothed gear comprises a pivot arm pivotable about a pivot axis in a direction towards and away from said toothed gear;

said pivot arm comprises tooth means for engaging between adjacent teeth of said toothed gear to inhibit rotation of said toothed gear; and said means for controlling operation of said member means comprises means for engaging said pivot arm, said means for engaging comprising:

a first position for maintaining said pivot arm pivoted away from said toothed gear to maintain said tooth means of said pivot arm out of engagement with said toothed gear during said first periods of operation, and a second position for pivoting of said pivot arm towards said toothed gear to engage said tooth means with said toothed gear during said second periods of operation; and said control means comprises means for moving said means for engaging between said first and second positions.

8. The printer according to claim 7, wherein:

said means for engaging said pivot arm comprises lever means pivotable about a pivot axis between said first and second positions;

said means for moving said means for engaging comprises:

cam means for engaging said lever means; and drive means for moving said cam means.

9. The printer according to claim 8, wherein:

said drive means for moving said cam means comprises a rotational member rotatable about an axis of rotation;

said lever means comprises a slot; and said cam means comprises pin means attached eccentrically to said axis of rotation of said rotational member, said pin means being disposed within said slot to move said lever means between said first and second positions upon rotation of said rotational member.

10. The printer according to claim 9, wherein:

said lever means comprises an angle lever, said angle lever having a corner portion with first and second arm means extending from said corner portion, and said first and second arm means being disposed angularly with respect to one another;

said slot means being disposed at said corner of said lever means;

said second arm means having a first end spaced away from said corner portion, said first end of said second arm means comprising said pivot axis of said lever means;

said first arm means extends from said corner of said lever means towards said pivot arm of said means for inhibiting movement; and said first arm means comprises a first end adjacent said pivot arm and said first end comprises a surface for engaging said pivot arm to pivot said pivot arm away from said toothed gear and allow said pivot arm to pivot towards said toothed gear.

11. The printer according to claims 10, wherein:

said first arm means extends approximately vertically;

said pivot arm comprises a single lever having a first end and a second end;

said first end of said pivot arm defines said pivot axis of said pivot arm;

said pivot arm pivots in a vertical plane about said pivot axis of said pivot arm;

said second end of said pivot arm comprises a portion for contacting said first end of said first arm means, said portion for contacting comprising a convex projection extending from said pivot arm;

said tooth means of said pivot arm is disposed between said first and second ends of said pivot arm;

said pivot arm is configured to pivot into engagement with said toothed gear under the force of gravity; and said approximately vertical first arm means is configured to lift said pivot arm means vertically away from said toothed gear to disengage said tooth means of said pivot arm from said toothed gear.

12. The printer according to claim 11, wherein:

said first end of said second arm means comprises an arm portion extending beyond said pivot axis of said lever means in a direction away from said corner portion, said arm portion comprising said means for at least partially reducing said biasing force;

said arm portion comprising means for engaging said print head to move said print head towards said counterpressure roller simultaneously with movement of said pivot arm away from said toothed gear and to move said print head away from said counterpressure roller simultaneously with movement of said pivot arm towards said toothed gear; and said drive means for moving said means for engaging rotates said rotational member through an arc of about 180 degrees to move said lever means from said first position to said second position to move said pin means between a first position substantially vertically above said axis of rotation of said rotational member to substantially vertically below said axis of rotation of said rotational member.

13. The printer according to claim 12, wherein:

said means for storing label material comprises a label roll;

said control means further comprises means for determining a presence of label material being unwound from said label roll;

said means for storing printing ribbon comprises cassette means having said first and second spool means disposed therein;

said control means further comprises means for determining a presence of a printing ribbon cassette disposed in said printer;

said printing ribbon comprises a thermal transfer printing ribbon;

said at least one printing element comprises a plurality of heatable elements for thermally transferring printing substance from said thermal transfer printing ribbon to said label material;

said first periods of operation comprises periods of printing said printing substance on said label material and said second periods of operation comprise non-printing periods where said label material is not to receive any printing thereon;

said control means further comprises:

memory means for storing at least data to be printed on said label material; and computer processor means for receiving said stored data and controlling printing by said printer;

said second feed means comprises a further drive roller for frictionally engaging said label material to feed said label material;

said printer comprises a second rotational drive means for driving said counterpressure roller, said further drive roller, and said second take-up spool means, said second rotational drive means being drivably connected to said counterpressure roller and said further drive roller by a first belt transmission, and said second take-up spool means being drivably connected to said counterpressure roller by a second belt transmission;

said first and second arm means of said lever means being disposed at about a 90 degree angle with respect to one another;

said second arm means defines a longitudinal axis;

said slot means of said lever means has a longitudinal dimension disposed substantially parallel to said longitudinal axis of said second arm means;

said arm portion of said second arm means comprises a hook shaped end portion;

said print head comprises pin means for engaging with said hook shaped end portion of said second arm means;

said hook shaped end portion for engaging said pin means of said print head to lift said print head away from said counterpressure roller against the force of said biasing means;

said cam means further comprises a half-disc shaped member disposed non-rotationally with said rotational member of said drive means for said lever means;

said half-disc shaped member having a first edge portion defined by a diameter of said half-disc member;

said printer further comprises optical sensor means for sensing said first edge portion of said half-disc member and determining the 180 degree rotations of said rotational member;

said teeth of said toothed gear comprise substantially square-shaped teeth disposed circumferentially about said toothed gear, and said teeth define substantially square-shaped spaces therebetween; and said tooth of said pivot arm comprises a substantially square-shaped tooth having rounded corners for guiding movement of said tooth into a space between teeth of said toothed gear.

14. A printer for transferring a printing substance from a printing ribbon to a material, said printer comprising:

means for storing the material to be printed upon;

means for storing printing ribbon, the printing ribbon comprising a printing substance thereon;

print means for printing on the material, said print means comprising at least one printing element, and said at least one printing element comprising means for transferring the printing substance from the printing ribbon to the material;

means for feeding printing ribbon and material to an area adjacent said at least one printing element;

means for moving said at least one printing element into and out of engagement with said printing ribbon and material, said means for moving being configured for moving said at least one printing element into engagement during at least first periods of operation of said printer and for moving said at least one printing element out of engagement during at least second periods of operation of said printer;

means for actuating said at least one printing element to transfer printing substance from said printing ribbon to the material to print on the material adjacent said at least one printing element;

said means for feeding comprising means for conjunctively feeding printing ribbon and material through the area adjacent said at least one printing element during at least said first periods of operation of said printer;

means for inhibiting transport of said printing ribbon by said means for conjunctively feeding during transport of said material by said means for conjunctively feeding during at least said second periods of operation of said printer;

said print means comprising:

a print head, said print head comprising said at least one printing element;

said print means further comprising:

biasing means for applying a biasing force for biasing said at least one printing element into engagement with said printing ribbon and said material;

said means for storing printing ribbon comprising spool means having the printing ribbon wrapped therearound, said spool means being rotatable about an axis of rotation in said means for storing to unwrap printing ribbon from said spool means;

said means for moving said at least one printing element into and out of engagement comprising lever means, said lever means comprising means for engaging said print head for moving said print head against said biasing force to move said at least one printing element out of engagement with said printing ribbon and said material during at least said second periods of operation;

a toothed gear;

means for non-rotationally connecting said toothed gear with said spool means for united rotation of said toothed gear with said spool means; and said lever means comprising first lever means and second lever means;

said second lever means comprising means for engaging said toothed gear to inhibit rotation of said toothed gear and inhibit rotation of said spool means;

said first lever means comprising a first portion for engaging said print head for moving said print head and a second portion for engaging said second lever means for moving said second lever means into and out of engagement with said toothed gear.

15. The printer according to claim 14, wherein:

said means for feeding comprises means for pulling ribbon off of said spool means to rotate said spool means and unwrap printing ribbon from said spool means; and said lever means comprises means for inhibiting rotation of said spool means during at least said second periods of operation to prevent said ribbon means from being unwrapped from said spool means.

16. The printer according to claim 15, wherein:

said print means comprises counterpressure means disposed adjacent said at least one printing element of said print head;

said biasing means for applying a biasing force to said print head to engage said printing ribbon and material between said print head and said counterpressure means;

said printer further comprises:

means for providing said printing ribbon between said print head and said counterpressure means; and means for providing said material between said printing ribbon and said counterpressure means.

17. The printer according to claim 16, further comprising:

control means for controlling operation of said printer;

said biasing means being configured for frictionally engaging said printing ribbon and said material between said print head and said counterpressure means during said first periods of operation;

said counterpressure means comprises a counterpressure roller, said counterpressure roller being mounted in a fixed position within said printer;

said feed means comprises first feed means for rotatably driving said counterpressure roller to feed said frictionally engaged material and said printing ribbon through said area adjacent said at least one printing element during at least said first periods of operation;

said lever means being configured for moving said print head away from said counterpressure roller to reduce frictional engagement of said printing ribbon and said material between said print head and said counterpressure means during at least said second periods of operation;

said feed means further comprises second feed means for feeding material to said counterpressure roller and through said area adjacent said at least one printing element independently of said counterpressure roller during said second periods of operation;

said control means comprising means for moving said first lever means between a first position for said first periods of operation and a second position for said second periods of operation;

said first lever means in said first position being configured for permitting biasing of said print head towards said counterpressure roller and for maintaining said means for engaging of said second lever means out of engagement with said toothed gear; and said first lever means in said second position being configured for opposing said biasing force and lifting said print head away from said printing ribbon and for permitting said means for engaging of said second lever means to pivot into engagement with said toothed gear.

18. The printer according to claim 17, wherein:

said spool means comprises first spool means for supplying printing ribbon;

said printer further comprises take-up means for taking-up printing ribbon fed through said area adjacent said at least one printing element, said take up means comprising:

second spool means for winding printing ribbon therearound;

drive means for rotatably driving said second spool means to wrap said printing ribbon around said second spool means; and slip clutch means disposed between said spool means and said drive means to minimize tensile stress on said ribbon means during at least said second periods of operation when said printing ribbon is prevented from unwrapping from said first spool means;

said toothed gear comprises a circumference, and said toothed gear comprises a plurality of teeth spaced apart about said circumference thereof;

said second lever means comprises a pivot arm pivotable about a pivot axis in a direction towards and away from said toothed gear;

said pivot arm comprises tooth means for engaging between adjacent teeth of said toothed gear to inhibit rotation of said toothed gear;

said control means comprises means for moving said first lever means between said first and second positions;

said first lever means being pivotable about a pivot axis between said first and second positions;

said means for moving said first lever means comprises: cam means for engaging said first lever means; and drive means for moving said cam means;

said drive means for moving said cam means comprises a rotational member rotatable about an axis of rotation;

said first lever means comprises a slot;

said cam means comprises pin means attached eccentrically to said axis of rotation of said rotational member, said pin means being disposed within said slot to move said first lever means between said first and second positions upon rotation of said rotational member;

said first lever means comprises an angle lever, said angle lever having a corner portion with first and second arm means extending from said corner portion, and said first and second arm means being disposed angularly with respect to one another;

said slot means being disposed at said corner of said first lever means;

said second arm means having a first end spaced away from said corner portion, said first end of said second arm means comprising said pivot axis of said lever means, and said means for engaging said print head;

said first arm means extends from said corner of said lever means towards said pivot arm;

said first arm means comprises a first end adjacent said pivot arm and said first end comprises a surface for engaging said pivot arm to pivot said pivot arm away from said toothed gear and allow said pivot arm to pivot towards said toothed gear;

said first arm means extends approximately vertically;

said pivot arm comprises a single lever having a first end and a second end;

said first end of said pivot arm defines said pivot axis of said pivot arm;

said pivot arm pivots in a vertical plane about said pivot axis of said pivot arm;

said second end of said pivot arm comprises a portion for contacting said first end of said first arm means, said portion for contacting comprising a convex projection extending from said pivot arm;

said tooth means of said pivot arm is disposed between said first and second ends of said pivot arm;

said pivot arm is configured to pivot into engagement with said toothed gear under the force of gravity;

said approximately vertical first arm means is configured to lift said pivot arm means vertically away from said toothed gear to disengage said tooth means of said pivot arm from said toothed gear;

said first end of said second arm means comprises an arm portion extending beyond said pivot axis of said lever means in a direction away from said corner portion, said arm portion comprising said means for engaging said print head;

said drive means for moving said means for engaging rotates said rotational member through an arc of about 180 degrees to move said first lever means from said first position to said second position to move said pin means between a first position substantially vertically above said axis of rotation of said rotational member to substantially vertically below said axis of rotation of said rotational member;

said means for storing material to be printed comprises a roll of material to be printed;

said control means further comprises means for determining a presence of material being unwound from said roll;

said means for storing printing ribbon comprises cassette means having said first and second spool means disposed therein;

said control means further comprises means for determining a presence of a printing ribbon cassette disposed in said printer;

said printing ribbon comprises a thermal transfer printing ribbon;

said at least one printing element comprises a plurality of heatable elements for thermally transferring printing substance from said thermal transfer printing ribbon to said material;

said first periods of operation comprise periods of printing said printing substance on said material and said second periods of operation comprise non-printing periods where said material is not to receive any printing thereon;

said control means further comprises:

memory means for storing at least data to be printed on said label material; and computer processor means for receiving said stored data and controlling printing by said printer;

said second feed means comprises a further drive roller for frictionally engaging said material to feed said material;

said printer comprises a second rotational drive means for driving said counterpressure roller, said further drive roller, and said second take-up spool means, said second rotational drive means being drivably connected to said counterpressure roller and said further drive roller by a first belt transmission, and said second take-up spool means being drivably connected to said counterpressure roller by a second belt transmission;

said first and second arm means of said first lever means being disposed at about a 90 degree angle with respect to one another;

said second arm means defines a longitudinal axis;

said slot means of said first lever means has a longitudinal dimension disposed substantially parallel to said longitudinal axis of said second arm means;

said arm portion of said second arm means comprises a hook shaped end portion;

said print head comprises pin means for engaging with said hook shaped end portion of said second arm means;

said hook shaped end portion for engaging said pin means of said print head to lift said print head away from said counterpressure roller against the force of said biasing means;

said cam means further comprises a half-disc shaped member disposed non-rotationally with said rotational member of said drive means for said first lever means;

said half-disc shaped member having a first edge portion defined by a diameter of said half-disc member;

said printer further comprises optical sensor means for sensing said first edge portion of said half-disc member and determining the 180 degree rotations of said rotational member;

said teeth of said toothed gear comprise substantially square-shaped teeth disposed circumferentially about said toothed gear, and said teeth define substantially square-shaped spaces therebetween; and said tooth of said pivot arm comprises a substantially square-shaped tooth having rounded corners for guiding movement of said tooth into a space between teeth of said toothed gear.

* * * * *

UNITED STATES PATENT AND TRADEMARK OFFICE

CERTIFICATE OF CORRECTION

PATENT NO. : 5,542,769

DATED : August 6, 1996

INVENTOR(S) : Peter SCHNEIDER and Dirk UMBACH

It is certified that error appears in the above-indentified patent and that said Letters Patent is hereby corrected as shown below:

In column 6, line 41, after the second occurrence of 'arm', delete "101" and insert --10--.

In column 15, line 36, after ' 23", ' insert --i.e.--.

In column 18, line 8, after 'simply' delete "be".

Signed and Sealed this

Seventh Day of January, 1997

*Attest:*

Bruce Lehman

BRUCE LEHMAN

*Attesting Officer*

*Commissioner of Patents and Trademarks*